US009726097B2

(12) United States Patent
Nakagawa et al.

(10) Patent No.: US 9,726,097 B2
(45) Date of Patent: Aug. 8, 2017

(54) CONTROL SYSTEM OF INTERNAL COMBUSTION ENGINE

(71) Applicant: TOYOTA JIDOSHA KABUSHIKI KAISHA, Toyota-shi, Aichi (JP)

(72) Inventors: Norihisa Nakagawa, Susono (JP); Shuntaro Okazaki, Shizuoka (JP); Yuji Yamaguchi, Susono (JP)

(73) Assignee: TOYOTA JIDOSHA KABUSHIKI KIASHA, Toyota-shi, Aichi (JP)

( * ) Notice: Subject to any disclaimer, the term of this patent is extended or adjusted under 35 U.S.C. 154(b) by 0 days.

(21) Appl. No.: 15/025,073

(22) PCT Filed: Sep. 26, 2014

(86) PCT No.: PCT/JP2014/075603
§ 371 (c)(1),
(2) Date: Mar. 25, 2016

(87) PCT Pub. No.: WO2015/046415
PCT Pub. Date: Apr. 2, 2015

(65) Prior Publication Data

US 2016/0215717 A1 Jul. 28, 2016

(30) Foreign Application Priority Data

Sep. 27, 2013 (JP) ..... 2013-201974

(51) Int. Cl.

| | |
|---|---|
| ***F01N 3/00*** | (2006.01) |
| ***F02D 41/02*** | (2006.01) |
| ***F02D 41/14*** | (2006.01) |
| ***F01N 3/20*** | (2006.01) |
| ***F01N 3/28*** | (2006.01) |

(Continued)

(52) U.S. Cl.
CPC ..... *F02D 41/0295* (2013.01); *F01N 3/20* (2013.01); *F01N 3/28* (2013.01); *F01N 13/008* (2013.01);
(Continued)

(58) Field of Classification Search
CPC ..... F02D 41/0295; F02D 41/1441; F02D 41/1454; F02D 41/0002; F01N 3/20
(Continued)

(56) References Cited

U.S. PATENT DOCUMENTS

| | | | |
|---|---|---|---|
| 5,758,490 | A | 6/1998 | Maki et al. |
| 2010/0217506 | A1 | 8/2010 | Mizoguchi et al. |

FOREIGN PATENT DOCUMENTS

| | | | |
|---|---|---|---|
| EP | 2952715 | A1 | 12/2015 |
| JP | H8-232723 | A | 9/1996 |

(Continued)

OTHER PUBLICATIONS

English translation of Japanese Patent Application Publication No. JP 2010138705A (Jun. 2010).*

*Primary Examiner* — Jason Shanske
(74) *Attorney, Agent, or Firm* — Andrews Kurth Kenyon LLP

(57) ABSTRACT

A control device for an internal combustion engine, said control device implementing a lean control, whereby the air-fuel ratio of the exhaust gas flowing into an exhaust purification catalyst is set to a lean air-fuel ratio setting, and a rich control, whereby the air-fuel ratio of the exhaust gas flowing into the exhaust purification catalyst is set to a rich air-fuel ratio setting. When the amount of oxygen absorbed by the exhaust purification catalyst during lean control reaches or exceeds a criterion storage amount, a control is executed to switch to rich control. In addition, a control is executed to set the lean air-fuel ratio setting for a first intake (Continued)

air amount so as to be richer than the lean air-fuel ratio setting for a second intake air amount that is less than the first intake air amount.

3 Claims, 14 Drawing Sheets

(51) Int. Cl.
*F01N 13/00* (2010.01)
*F02B 77/08* (2006.01)
*F02D 41/00* (2006.01)

(52) U.S. Cl.
CPC ..... *F02B 77/086* (2013.01); *F02D 41/0002* (2013.01); *F02D 41/1441* (2013.01); *F02D 41/1454* (2013.01); *F01N 2560/025* (2013.01); *F01N 2560/14* (2013.01); *F01N 2900/1624* (2013.01); *F02D 41/1475* (2013.01); *F02D 2200/0814* (2013.01); *F02D 2200/0816* (2013.01)

(58) Field of Classification Search
USPC ..... 60/285
See application file for complete search history.

(56) References Cited

FOREIGN PATENT DOCUMENTS

| | | | | |
|---|---|---|---|---|
| JP | 2001-234787 | A | | 8/2001 |
| JP | 2005-256797 | A | | 9/2005 |
| JP | 2009-162139 | A | | 7/2009 |
| JP | 2009-203910 | A | | 9/2009 |
| JP | 2010-138705 | A | | 6/2010 |
| JP | 2010138705 | A | * | 6/2010 |
| JP | 2011-069337 | A | | 4/2011 |
| JP | 2012-177316 | A | | 9/2012 |
| JP | 2012177316 | A | * | 9/2012 |
| WO | 2009/106940 | A1 | | 9/2009 |
| WO | 2014/118892 | A1 | | 8/2014 |

* cited by examiner

CONTROL SYSTEM OF INTERNAL COMBUSTION ENGINE

CROSS-REFERENCE TO RELATED APPLICATIONS

This is a national phase application based on the PCT International Patent Application No. PCT/JP2014/075603 filed Sep. 26, 2014, claiming priority to Japanese Patent Application No. 2013-201974 filed Sep. 27, 2013, the entire contents of both of which are incorporated herein by reference.

TECHNICAL FIELD

The present invention relates to a control system of an internal combustion engine.

BACKGROUND ART

The exhaust gas discharged from a combustion chamber contains unburned gas, $NO_X$, etc. To remove such components of the exhaust gas, an exhaust purification catalyst is arranged in an engine exhaust passage. As an exhaust purification catalyst able to simultaneously remove unburned gas, $NO_X$, and other components, a three-way catalyst is known. A three-way catalyst can remove unburned gas, $NO_X$, etc. with a high removal rate when an air-fuel ratio of the exhaust gas is near a stoichiometric air-fuel ratio. For this reason, there is known a control system which provides an air-fuel ratio sensor in an exhaust passage of an internal combustion engine and uses the output value of this air-fuel ratio sensor as the basis to control an amount of fuel fed to the internal combustion engine.

As the exhaust purification catalyst, one having an oxygen storage ability can be used. An exhaust purification catalyst having an oxygen storage ability can remove unburned gas (HC, CO, etc.), $NO_X$, etc. when the oxygen storage amount is a suitable amount between an upper limit storage amount and a lower limit storage amount even_if the air-fuel ratio of the exhaust gas flowing into the exhaust purification catalyst is rich. If exhaust gas of an air-fuel ratio at the rich side from the stoichiometric air-fuel ratio (below, referred to as a "rich air-fuel ratio") flows into the exhaust purification catalyst, the oxygen stored in the exhaust purification catalyst is used to remove by oxidation the unburned gas in the exhaust gas.

Conversely, if exhaust gas of an air-fuel ratio at a lean side from the stoichiometric air-fuel ratio (below, referred to as a "lean air-fuel ratio") flows into the exhaust purification catalyst, the oxygen in the exhaust gas is stored in the exhaust purification catalyst. Due to this, the surface of the exhaust purification catalyst becomes an oxygen deficient state. Along with this, the $NO_X$ in the exhaust gas is removed by reduction. In this way, the exhaust purification catalyst can purify the exhaust gas so long as the oxygen storage amount is a suitable amount regardless of the air-fuel ratio of the exhaust gas flowing into the exhaust purification catalyst.

Therefore, in such a control system, to maintain the oxygen storage amount at the exhaust purification catalyst at a suitable amount, an air-fuel ratio sensor is provided at the upstream side of the exhaust purification catalyst in the direction of flow of exhaust, and an oxygen sensor is provided at the downstream side in the direction of flow of exhaust. Using these sensors, the control system uses the output of the upstream side air-fuel ratio sensor as the basis for feedback control so that the output of this air-fuel ratio sensor becomes a target value corresponding to the target air-fuel ratio. In addition, the output of the downstream side oxygen sensor is used as the basis to correct the target value of the upstream side air-fuel ratio sensor.

For example, in the control system described in Japanese Patent Publication No. 2011-069337A, when the output voltage of the downstream side oxygen sensor is a high side threshold value or more and the exhaust purification catalyst is in an oxygen deficient state, the target air-fuel ratio of the exhaust gas flowing into the exhaust purification catalyst is made a lean air-fuel ratio. Conversely, when the output voltage of the downstream side oxygen sensor is a low side threshold value or less and the exhaust purification catalyst is in an oxygen excess state, the target air-fuel ratio is made a rich air-fuel ratio. Due to this control, when in the oxygen deficient state or oxygen excess state, it is considered possible to quickly return the state of the exhaust purification catalyst to a state between these two states, that is, a state where the exhaust purification catalyst stores a suitable amount of oxygen.

Further, in the control system described in Japanese Patent Publication No. 2001-234787A, the outputs of an air flowmeter and upstream side air-fuel ratio sensor of an exhaust purification catalyst etc. are used as the basis to calculate an oxygen storage amount of the exhaust purification catalyst. In addition, when the calculated oxygen storage amount is larger than a target oxygen storage amount, the target air-fuel ratio of the exhaust gas flowing into the exhaust purification catalyst is made a rich air-fuel ratio, and when the calculated oxygen storage amount is smaller than a target oxygen storage amount, the target air-fuel ratio is made the lean air-fuel ratio. Due to this control, it is considered that the oxygen storage amount of the exhaust purification catalyst can be maintained constant at the target oxygen storage amount.

CITATION LIST

Patent Literature

PLT 1. Japanese Patent Publication No. 2011-069337A
PLT 2. Japanese Patent Publication No. 2001-234787A
PLT 3. Japanese Patent Publication No. 8-232723A
PLT 4. Japanese Patent Publication No. 2009-162139A

SUMMARY OF INVENTION

Technical Problem

An exhaust purification catalyst having an oxygen storage ability becomes hard to store the oxygen in the exhaust gas when the oxygen storage amount becomes near the maximum oxygen storage amount if the air-fuel ratio of the exhaust gas flowing into the exhaust purification catalyst is a lean air-fuel ratio. The inside of the exhaust purification catalyst becomes a state of oxygen excess. The $NO_X$ contained in the exhaust gas becomes hard to be removed by reduction. For this reason, if the oxygen storage amount becomes near the maximum oxygen storage amount, the concentration of $NO_X$ of the exhaust gas flowing out from the exhaust purification catalyst rapidly rises.

For this reason, as disclosed in Japanese Patent Publication No. 2011-069337A, if control is performed to set the target air-fuel ratio to the rich air-fuel ratio when the output voltage of the downstream side oxygen sensor has become the low side threshold value or less, there is the problem that a certain extent of $NO_X$ flows out from the exhaust purification catalyst.

FIG. 16 is a time chart explaining the relationship between an air-fuel ratio of exhaust gas flowing into an exhaust purification catalyst and a concentration of $NO_X$ flowing out from the exhaust purification catalyst. FIG. 16 is a time chart of the oxygen storage amount of the exhaust purification catalyst, the air-fuel ratio of the exhaust gas detected by the downstream side oxygen sensor, the target air-fuel ratio of the exhaust gas flowing into the exhaust purification catalyst, the air-fuel ratio of the exhaust gas detected by the upstream side air-fuel ratio sensor, and the concentration of $NO_X$ in the exhaust gas flowing out from the exhaust purification catalyst.

In the state before the time $t_1$, the target air-fuel ratio of the exhaust gas flowing into the exhaust purification catalyst is made a lean air-fuel ratio. For this reason, the oxygen storage amount of the exhaust purification catalyst is gradually increased. On the other hand, all of the oxygen in the exhaust gas flowing into the exhaust purification catalyst is stored in the exhaust purification catalyst, so the exhaust gas flowing out from the exhaust purification catalyst does not contain much oxygen at all. For this reason, the air-fuel ratio of the exhaust gas detected by the downstream side oxygen sensor becomes substantially the stoichiometric air-fuel ratio. In the same way, the $NO_X$ in the exhaust gas flowing into the exhaust purification catalyst is completely removed by reduction in the exhaust purification catalyst, so the exhaust gas flowing out from the exhaust purification catalyst does not contain much $NO_X$ at all.

When the oxygen storage amount of the exhaust purification catalyst gradually increases and approaches the maximum oxygen storage amount Cmax, part of the oxygen in the exhaust gas flowing into the exhaust purification catalyst is no longer be stored in the exhaust purification catalyst. As a result, from the time $t_1$, the exhaust gas flowing out from the exhaust purification catalyst starts to contain oxygen. For this reason, the air-fuel ratio of the exhaust gas detected by the downstream side oxygen sensor becomes the lean air-fuel ratio. After that, when the oxygen storage amount of the exhaust purification catalyst further increases, the air-fuel ratio of the exhaust gas flowing out from the exhaust purification catalyst reaches a predetermined upper limit air-fuel ratio AFhighref (corresponding to low side threshold value) and the target air-fuel ratio is switched to a rich air-fuel ratio.

If the target air-fuel ratio is switched to a rich air-fuel ratio, the fuel injection amount in the internal combustion engine is made to increase to match the switched target air-fuel ratio. Even if the fuel injection amount is increased in this way, there is a certain extent of distance from the internal combustion engine body to the exhaust purification catalyst, so the air-fuel ratio of the exhaust gas flowing into the exhaust purification catalyst does not immediately change to the rich air-fuel ratio. A delay occurs. For this reason, even if the target air-fuel ratio is switched at the time $t_2$ to the rich air-fuel ratio, up to the time $t_3$, the air-fuel ratio of the exhaust gas flowing into the exhaust purification catalyst remains at the lean air-fuel ratio. For this reason, in the interval from the time $t_2$ to the time $t_3$, the oxygen storage amount of the exhaust purification catalyst reaches the maximum oxygen storage amount Cmax or becomes a value near the maximum oxygen storage amount Cmax and, as a result, oxygen and $NO_X$ flow out from the exhaust purification catalyst. After that, at the time $t_3$, the air-fuel ratio of the exhaust gas flowing into the exhaust purification catalyst becomes the rich air-fuel ratio, and the air-fuel ratio of the exhaust gas flowing out from the exhaust purification catalyst converges to the stoichiometric air-fuel ratio.

In this way, a delay occurs from when switching the target air-fuel ratio from the lean air-fuel ratio to the rich air-fuel ratio to when the air-fuel ratio of the exhaust gas flowing into the exhaust purification catalyst becomes the rich air-fuel ratio. As a result, in the time period from the time $t_1$ to the time $t_4$, $NO_X$ ended up flowing out from the exhaust purification catalyst.

An object of the present invention is to provide a control system of an internal combustion engine provided with an exhaust purification catalyst having an oxygen storage ability, which suppresses the outflow of $NO_X$.

A control system of an internal combustion engine of the present invention is a control system of an internal combustion engine provided with an exhaust purification catalyst having an oxygen storage ability in an engine exhaust passage, and comprises an upstream side air-fuel ratio sensor arranged upstream of the exhaust purification catalyst and detecting the air-fuel ratio of the exhaust gas flowing into the exhaust purification catalyst and a downstream side air-fuel ratio sensor arranged downstream of the exhaust purification catalyst and detecting the air-fuel ratio of the exhaust gas flowing out from the exhaust purification catalyst. The control system performs lean control to intermittently or continuously make the air-fuel ratio of the exhaust gas flowing into the exhaust purification catalyst a lean set air-fuel ratio leaner than a stoichiometric air-fuel ratio until an oxygen storage amount of the exhaust purification catalyst becomes a judgment reference storage amount, which is the maximum oxygen storage amount or less, or becomes more, and rich control to intermittently or continuously make the air-fuel ratio of the exhaust gas flowing into the exhaust purification catalyst a rich set air-fuel ratio richer than the stoichiometric air-fuel ratio until an output of the downstream side air-fuel ratio sensor becomes a rich judged air-fuel ratio, which is an air-fuel ratio richer than the stoichiometric air-fuel ratio, or become less, and performs control to switch to the rich control when the oxygen storage amount becomes the judgment reference storage amount or more during the time period of lean control and switch to the lean control when the output of the downstream side air-fuel ratio sensor becomes the rich judged air-fuel ratio or less during the time period of rich control. The control system further performs control to set the lean set air-fuel ratio at a first intake air amount to a rich side from the lean set air-fuel ratio at a second intake air amount smaller than the first intake air amount when comparing the lean set air-fuel ratio at the first intake air amount with the lean set air-fuel ratio at the second intake air amount.

In the above invention, control to set the lean set air-fuel ratio to a rich side the more the intake air amount increases can be performed.

In the above invention, a region of a high intake air amount can be set in advance, in the region of the high intake air amount, the lean set air-fuel ratio can be set to the rich side the more the intake air amount increases, and, in a region of an intake air amount smaller than the region of the high intake air amount, the lean set air-fuel ratio can be maintained constant.

Solution to Problem

According to the present invention, there is provided a control system of an internal combustion engine which suppresses the outflow of $NO_X$.

DESCRIPTION OF EMBODIMENTS

Referring to FIG. 1 to FIG. 15, a control system of an internal combustion engine of an embodiment will be explained. The internal combustion engine in the present embodiment is provided with an engine body outputting a rotational force and an exhaust processing system purifying the exhaust flowing out from the combustion chamber.

Explanation of Internal Combustion Engine as a Whole

Figure 1:
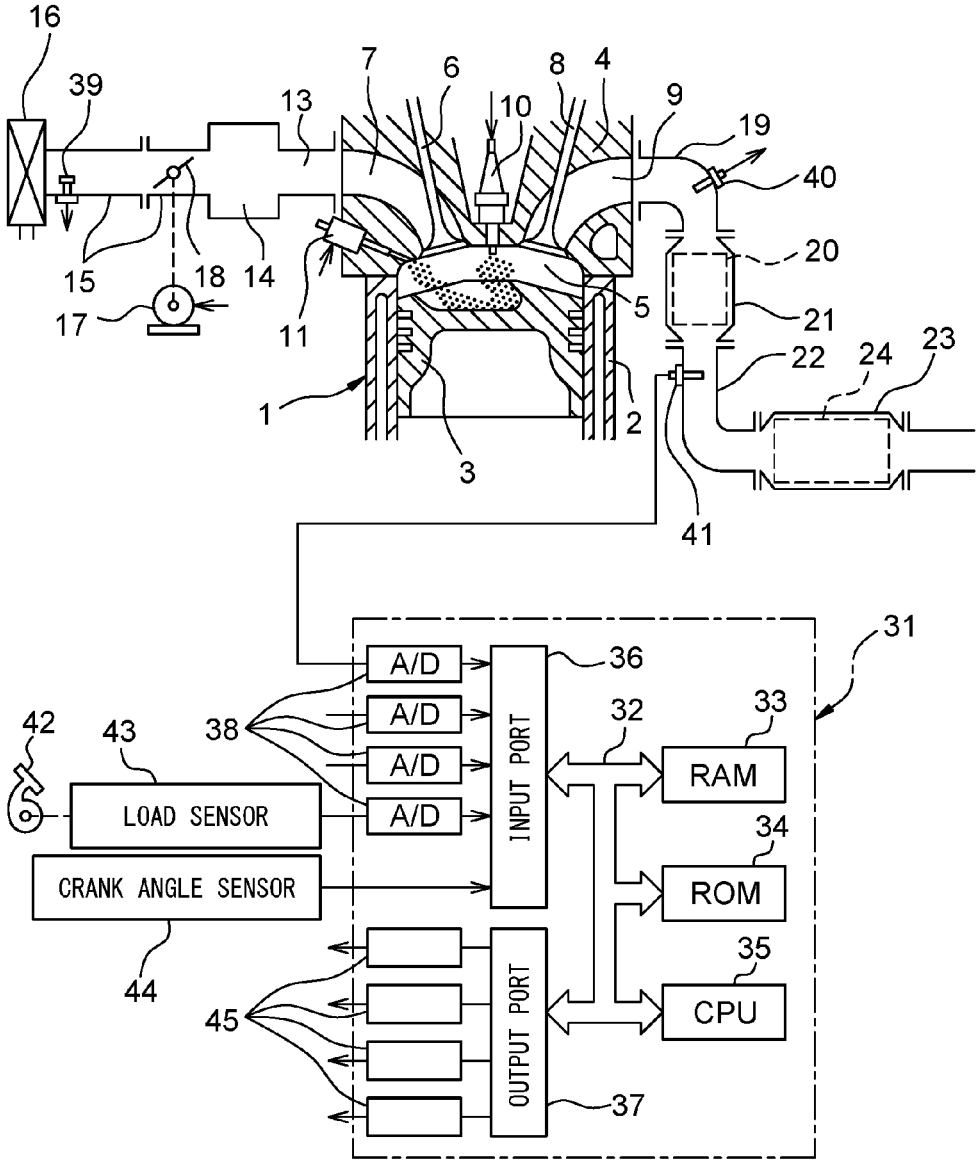
FIG. 1 is a schematic view of an internal combustion engine in an embodiment.

FIG. 1 is a view schematically showing an internal combustion engine in the present embodiment. The internal combustion engine is provided with an engine body 1. The engine body 1 includes a cylinder block 2 and a cylinder head 4 which is fastened to the cylinder block 2. Bore parts are formed in the cylinder block 2. Pistons 3 are arranged reciprocating inside the bore parts. Combustion chambers 5 are formed by the spaces surrounded by the bore parts of the cylinder block 2, pistons 3, and cylinder head 4. The cylinder head 4 is formed with intake ports 7 and exhaust ports 9. The intake valves 6 are formed to open and close the intake ports 7, while exhaust valves 8 are formed to open and close the exhaust ports 9.

At the inside wall surface of the cylinder head 4, at a center part of each combustion chamber 5, a spark plug 10 is arranged. At a circumferential part at the inside wall surface of the cylinder head 4, a fuel injector 11 is arranged. The spark plug 10 is configured to generate a spark in accordance with an ignition signal. Further, the fuel injector 11 injects a predetermined amount of fuel into each combustion chamber 5 in accordance with an injection signal. Note that, the fuel injector 11 may also be arranged to inject fuel into an intake port 7. Further, in the present embodiment, as the fuel, gasoline with a stoichiometric air-fuel ratio of 14.6 is used. However, the internal combustion engine of the present invention may also use other fuel.

The intake port 7 of each cylinder is connected through a corresponding intake runner 13 to a surge tank 14, while the surge tank 14 is connected through an intake pipe 15 to an air cleaner 16. The intake ports 7, intake runners 13, surge tank 14, and intake pipe 15 form an "engine intake passage". Further, inside the intake pipe 15, a throttle valve 18 driven by a throttle valve driving actuator 17 is arranged. The throttle valve 18 can be operated by the throttle valve drive actuator 17 whereby it is possible to change the opening area of the intake passage.

On the other hand, the exhaust port 9 of each cylinder is connected to an exhaust manifold 19. The exhaust manifold 19 has a plurality of runners which are connected to the exhaust ports 9 and a header at which these runners merge. The header of the exhaust manifold 19 is connected to an upstream side casing 21 in which an upstream side exhaust purification catalyst 20 is provided. The upstream side casing 21 is connected through an exhaust pipe 22 to a downstream side casing 23 in which a downstream side exhaust purification catalyst 24 is provided. The exhaust ports 9, exhaust manifold 19, upstream side casing 21, exhaust pipe 22, and downstream side casing 23 form an "engine exhaust passage".

The control system of an internal combustion engine of the present embodiment includes an electronic control unit (ECU) 31. The electronic control unit 31 in the present embodiment is comprised of a digital computer which is provided with parts connected with each other through a bidirectional bus 32 such as a RAM (random access memory) 33, ROM (read only memory) 34, CPU (microprocessor) 35, input port 36, and output port 37.

Inside the intake pipe 15, an air flowmeter 39 is arranged for detecting the flow rate of air flowing through the inside of the intake pipe 15. The output of this air flowmeter 39 is input through a corresponding AD converter 38 to the input port 36.

Further, at the header of the exhaust manifold 19, an upstream side air-fuel ratio sensor 40 is arranged for detecting the air-fuel ratio of the exhaust gas flowing through the inside of the exhaust manifold 19 (that is, the exhaust gas flowing into the upstream side exhaust purification catalyst 20). In addition, inside the exhaust pipe 22, a downstream side air-fuel ratio sensor 41 is arranged for detecting the air-fuel ratio of the exhaust gas flowing through the inside of the exhaust pipe 22 (that is, the exhaust gas flowing out from the upstream side exhaust purification catalyst 20 and flowing into the downstream side exhaust purification catalyst 24). The outputs of these air-fuel ratio sensors are also input through the corresponding AD converters 38 to the input port 36. Note that, the configurations of these air-fuel ratio sensors will be explained later.

Further, an accelerator pedal 42 is connected to a load sensor 43 for generating an output voltage proportional to the amount of depression of the accelerator pedal 42, while the output voltage of the load sensor 43 is input through a corresponding AD converter 38 to the input port 36. The crank angle sensor 44, for example, generates an output pulse each time a crankshaft rotates by 15 degrees. This output pulse is input to the input port 36. The CPU 35 calculates the engine speed from the output pulses of the crank angle sensor 44. On the other hand, the output port 37 is connected through the corresponding drive circuit 45 to the spark plugs 10, fuel injectors 11, and the throttle valve drive actuator 17.

Explanation of Exhaust Purification Catalyst

The exhaust processing system of an internal combustion engine of the present embodiment is provided with a plurality of exhaust purification catalysts. The exhaust processing system of the present embodiment includes an upstream side exhaust purification catalyst 20 and a downstream side exhaust purification catalyst 24 arranged downstream from the exhaust purification catalyst 20. The upstream side exhaust purification catalyst 20 and downstream side exhaust purification catalyst 24 have similar configurations. Below, only the upstream side exhaust purification catalyst 20 will be explained, but the downstream side exhaust purification catalyst 24 also has a similar configuration and action.

The upstream side exhaust purification catalyst 20 is a three-way catalyst having an oxygen storage ability. Specifically, the upstream side exhaust purification catalyst 20 is comprised of a carrier made of a ceramic on which a precious metal having a catalytic action (for example, platinum (Pt), palladium (Pd), and rhodium (Rh)) and a substance having an oxygen storage ability (for example, ceria ($CeO_2$)) are carried. The upstream side exhaust purification catalyst 20 exhibits a catalytic action simultaneously removing unburned gas (HC, CO, etc.) and nitrogen oxides ($NO_X$) when reaching a predetermined activation temperature and also an oxygen storage ability.

According to the oxygen storage ability of the upstream side exhaust purification catalyst 20, the upstream side exhaust purification catalyst 20 stores the oxygen in the exhaust gas when the air-fuel ratio of the exhaust gas flowing into the upstream side exhaust purification catalyst 20 is leaner than the stoichiometric air-fuel ratio (lean air-fuel ratio). On the other hand, the upstream side exhaust purification catalyst 20 releases the oxygen stored in the upstream side exhaust purification catalyst 20 when the air-fuel ratio of the inflowing exhaust gas is richer than the stoichiometric air-fuel ratio (rich air-fuel ratio). Note that, the "air-fuel ratio of the exhaust gas" means the ratio of the mass of fuel to the mass of air fed until that exhaust gas is produced. Usually, it means the ratio of the mass of fuel to the mass of air fed to the inside of a combustion chamber 5 when the exhaust gas is generated. In the Description, the air-fuel ratio of the exhaust gas will sometimes be referred to as the "exhaust air-fuel ratio". Next, the relationship between the oxygen storage amount of the exhaust purification catalyst and purification ability in the present embodiment will be explained.

Figure 2A:
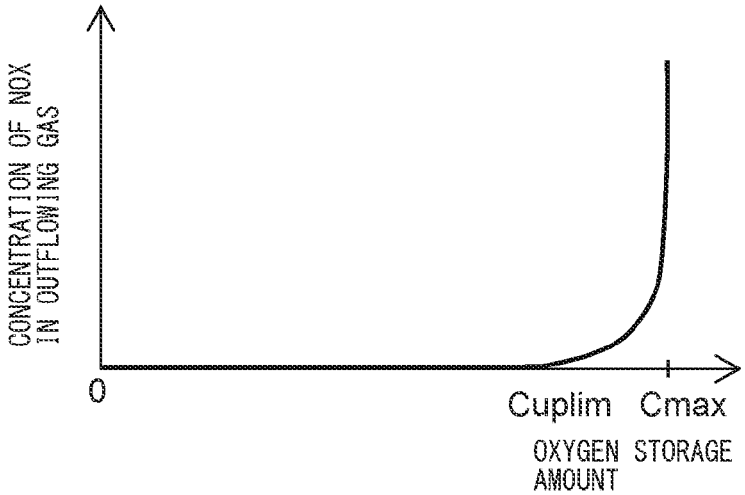
FIG. 2A is a view showing a relationship between an oxygen storage amount of an exhaust purification catalyst and $NO_X$ in exhaust gas flowing out from the exhaust purification catalyst.
Figure 2B:
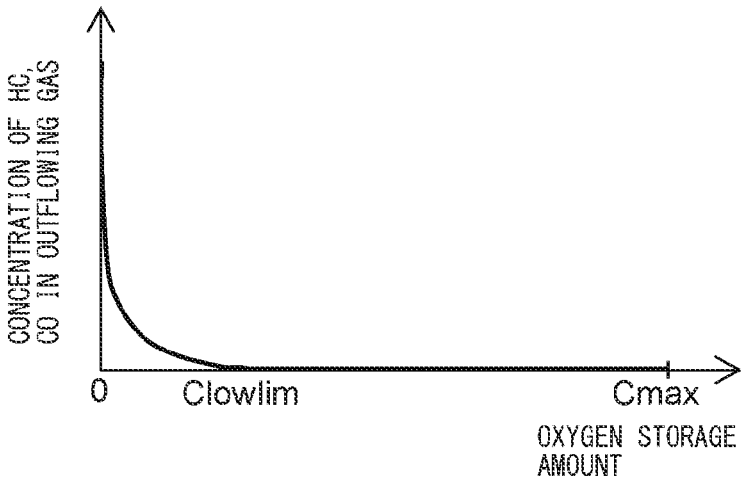
FIG. 2B is a view showing a relationship between an oxygen storage amount of an exhaust purification catalyst and a concentration of unburned gas in exhaust gas flowing out from the exhaust purification catalyst.

FIG. 2A and FIG. 2B shows the relationship between the oxygen storage amount of the exhaust purification catalyst and the concentration of the $NO_X$ and unburned gas (HC, CO, etc.) in the exhaust gas flowing out from the exhaust purification catalyst. FIG. 2A shows the relationship between the oxygen storage amount and the concentration of $NO_X$ in the exhaust gas flowing out from the exhaust purification catalyst when the air-fuel ratio of the exhaust gas flowing into the exhaust purification catalyst is a lean air-fuel ratio. On the other hand, FIG. 2B shows the relationship between the oxygen storage amount and the concentration of unburned gas in the exhaust gas flowing out from the exhaust purification catalyst when the air-fuel ratio of the exhaust gas flowing into the exhaust purification catalyst is a rich air-fuel ratio.

As will be understood from FIG. 2A, when the oxygen storage amount of the exhaust purification catalyst is small, there is an extra margin until the maximum oxygen storage amount. For this reason, even if the air-fuel ratio of the exhaust gas flowing into the exhaust purification catalyst is a lean air-fuel ratio (that is, this exhaust gas contains $NO_X$ and oxygen), the oxygen in the exhaust gas is stored in the exhaust purification catalyst. Along with this, $NO_X$ is also removed by reduction. As a result of this, the exhaust gas flowing out from the exhaust purification catalyst does not contain much $NO_X$.

However, if the oxygen storage amount of the exhaust purification catalyst becomes larger, when the air-fuel ratio of the exhaust gas flowing into the exhaust purification catalyst is a lean air-fuel ratio, it becomes harder for the exhaust purification catalyst to store the oxygen in the exhaust gas. Along with this, the $NO_X$ in the exhaust gas also becomes harder to be removed by reduction. For this reason, as will be understood from FIG. 2A, if the oxygen storage amount increases beyond the upper limit storage amount Cuplim near the maximum oxygen storage amount Cmax, the concentration of $NO_X$ in the exhaust gas flowing out from the exhaust purification catalyst rapidly rises.

On the other hand, when the oxygen storage amount of the exhaust purification catalyst is large, if the air-fuel ratio of the exhaust gas flowing into the exhaust purification catalyst is the rich air-fuel ratio (that is, this exhaust gas includes HC, CO, or other unburned gas), the oxygen stored in the exhaust purification catalyst is released. For this reason, the unburned gas in the exhaust gas flowing into the exhaust purification catalyst is removed by oxidation. As a result of this, as will be understood from FIG. 2B, the exhaust gas flowing out from the exhaust purification catalyst does not contain much unburned gas.

However, if the oxygen storage amount of the exhaust purification catalyst becomes smaller and becomes near 0, if the air-fuel ratio of the exhaust gas flowing into the exhaust purification catalyst is the rich air-fuel ratio, the oxygen released from the exhaust purification catalyst becomes smaller and along with this the unburned gas in the exhaust gas also becomes harder to be removed by oxidation. For this reason, as will be understood from FIG. 2B, if the oxygen storage amount decreases below a certain lower limit storage amount Clowlim, the concentration of unburned gas in the exhaust gas flowing out from the exhaust purification catalyst rapidly rises.

In the above way, according to the exhaust purification catalysts 20 and 24 used in the present embodiment, the characteristics of removal of $NO_X$ and unburned gas in the exhaust gas change according to the air-fuel ratios of the exhaust gas flowing into the exhaust purification catalysts 20 and 24 and their oxygen storage amounts. Note that, if having a catalytic action and oxygen storage ability, the exhaust purification catalysts 20 and 24 may be catalysts different from three-way catalysts.

Configuration of Air-Fuel Ratio Sensors

Figure 3:
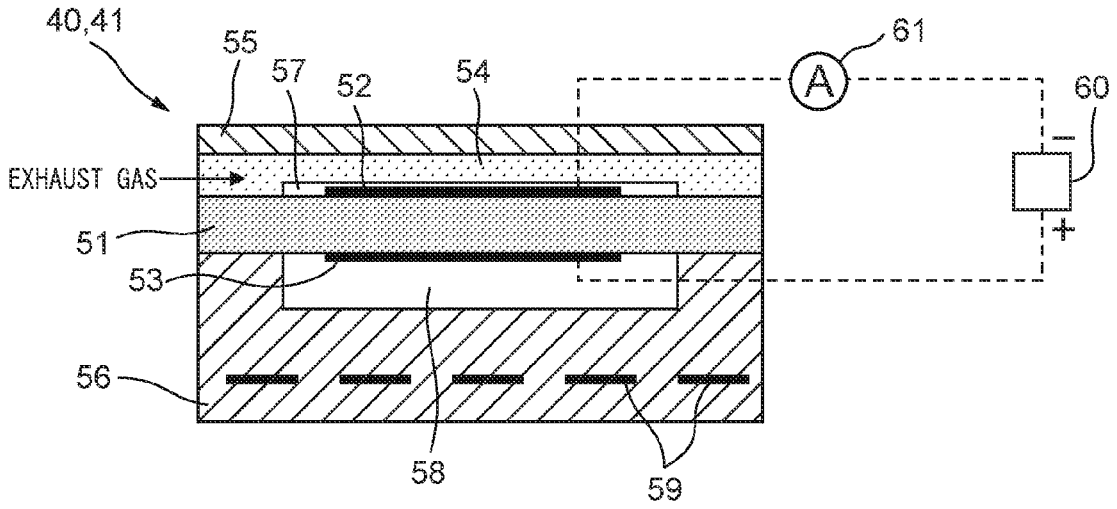
FIG. 3 is a schematic cross-sectional view of an air-fuel ratio sensor.

Next, referring to FIG. 3, the structures of the upstream side air-fuel ratio sensor 40 and downstream side air-fuel ratio sensor 41 in the present embodiment will be explained. FIG. 3 is a schematic cross-sectional view of an air-fuel ratio sensor. The air-fuel ratios sensor in the present embodiment are single-cell type air-fuel ratio sensors with one cell comprised of a solid electrolyte layer and a pair of electrodes. The air-fuel ratio sensors are not limited to this. It is also possible to employ other types of sensors where the output continuously changes in accordance with the air-fuel ratio of the exhaust gas. For example, it is also possible to employ two-cell type air-fuel ratio sensors.

Each air-fuel ratio sensor in the present embodiment is provided with a solid electrolyte layer 51, an exhaust side electrode (first electrode) 52 arranged on one side surface of the solid electrolyte layer 51, an atmosphere side electrode (second electrode) 53 arranged on the other side surface of the solid electrolyte layer 51, a diffusion regulating layer 54 regulating the diffusion of the exhaust gas passing through it, a protective layer 55 protecting the diffusion regulating layer 54, and a heater part 56 for heating the air-fuel ratio sensor.

One side surface of the solid electrolyte layer 51 is provided with a diffusion regulating layer 54, while the side surface at the opposite side from the side surface of the diffusion regulating layer 54 at the solid electrolyte layer 51 side is provided with a protective layer 55. In the present embodiment, a measured gas chamber 57 is formed between the solid electrolyte layer 51 and the diffusion regulating layer 54. The gas to be detected by the air-fuel ratio sensor, that is, the exhaust gas, is introduced through the diffusion regulating layer 54 into this measured gas chamber 57. Further, the exhaust side electrode 52 is arranged inside the measured gas chamber 57, Therefore, the exhaust side electrode 52 is exposed to the exhaust gas through the diffusion regulating layer 54. Note that, the measured gas chamber 57 does not necessarily have to be provided. The system may also be configured so that the diffusion regulating layer 54 directly contacts the surface of the exhaust side electrode 52.

On the other side surface of the solid electrolyte layer 51, the heater part 56 is provided. Between the solid electrolyte layer 51 and the heater part 56, a reference gas chamber 58 is formed. Inside this reference gas chamber 58, reference gas is introduced. In the present embodiment, the reference gas chamber 58 is opened to the atmosphere. Accordingly, inside the reference gas chamber 58, atmospheric air is introduced as the reference gas. The atmosphere side electrode 53 is arranged inside the reference gas chamber 58. Therefore, the atmosphere side electrode 53 is exposed to the reference gas (reference atmosphere). In the present embodiment, since atmospheric air is used as the reference gas, the atmosphere side electrode 53 is exposed to the atmosphere.

The heater part 56 is provided with a plurality of heaters 59. These heaters 59 can be used to control the temperature of the air-fuel ratio sensor, in particular the temperature of the solid electrolyte layer 51. The heater part 56 has a sufficient heat generation capacity for heating the solid electrolyte layer 51 until activation.

The solid electrolyte layer 51 is formed by a sintered body of $ZrO_2$ (zirconium), $HfO_2$, $ThO_2$, $Bi_2O_3$, or other oxygen ion conducting oxide in which CaO, MgO, $Y_2O_3$, $Yb_2O_3$, etc. is included as a stabilizer. Further, the diffusion regulating layer 54 is formed by a porous sintered body of alumina, magnesia, silica, spinel, mullite, or other heat resistant inorganic substance. Furthermore, the exhaust side electrode 52 and atmosphere side electrode 53 are formed by platinum or another high catalytic activity precious metal.

Further, between the exhaust side electrode 52 and atmosphere side electrode 53, sensor applied voltage Vr is applied by the voltage applying device 60 mounted in the electronic control unit 31. In addition, the electronic control unit 31 is provided with a current detection device 61 which detects the current flowing through the solid electrolyte layer 51 between the exhaust side electrode 52 and the atmosphere side electrode 53 when the voltage applying device 60 applies the sensor applied voltage Vr. The current detected by this current detection device 61 is the output current of the air-fuel ratio sensor.

Operation of Air-Fuel Ratio Sensors

Figure 4A:
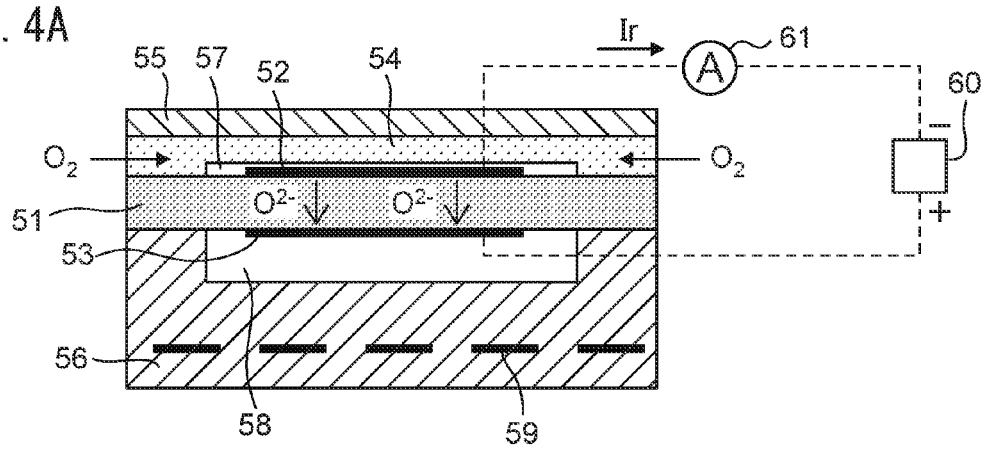
FIG. 4A is a first view schematically showing an operation of an air-fuel ratio sensor.
Figure 4B:
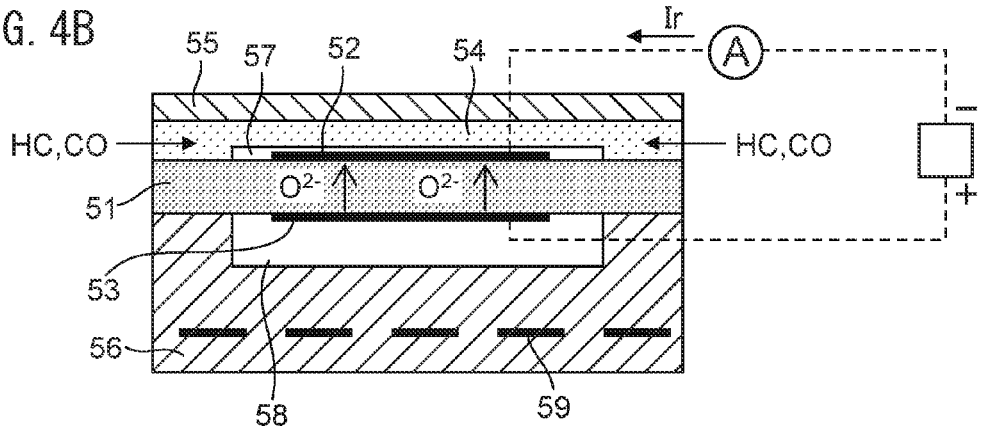
FIG. 4B is a second view schematically showing an operation of an air-fuel ratio sensor.
Figure 4C:
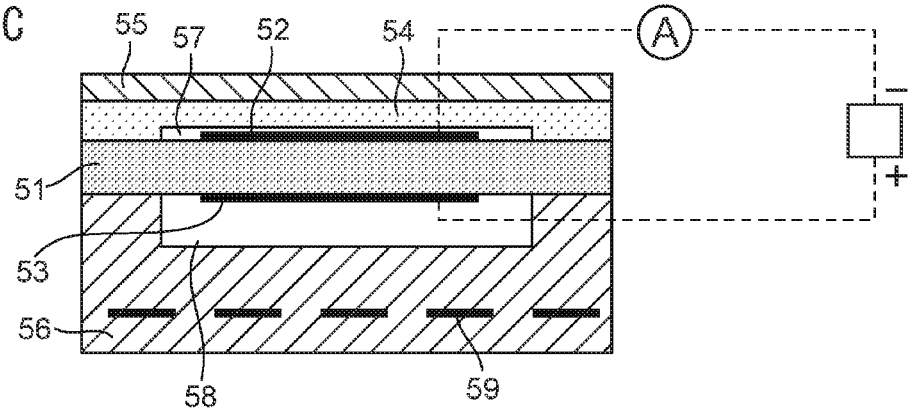
FIG. 4C is a third view schematically showing an operation of an air-fuel ratio sensor.

Next, referring to FIG. 4A to FIG. 4C, the basic concept of the operation of the thus configured air-fuel ratio sensors will be explained. FIG. 4A to FIG. 4C are views schematically showing the operation of an air-fuel ratio sensor. At the time of use, the air-fuel ratio sensor is arranged so that the outer circumferential surfaces of the protective layer 55 and diffusion regulating layer 54 are exposed to the exhaust gas. Further, atmospheric air is introduced into the reference gas chamber 58 of the air-fuel ratio sensor.

As explained above, the solid electrolyte layer 51 is formed by a sintered body of an oxygen ion conducting oxide. Therefore, it has the characteristic (oxygen cell characteristic) of an electromotive force E being generated prompting movement of oxygen ions from the high concentration side surface side to the low concentration side surface side if a difference in concentration of oxygen occurs between the two side surfaces of the solid electrolyte layer 51 in the state activated by a high temperature.

Conversely, the solid electrolyte layer 51 has the characteristic (oxygen pump characteristic) of prompting the movement of oxygen ions so that an oxygen concentration ratio occurs between the two side surfaces of the solid electrolyte layer according to the potential difference if a potential difference is given between the two side surfaces. Specifically, when a potential difference is given between the two side surfaces, movement of the oxygen ions is caused so that the concentration of oxygen at the side surface given the positive polarity becomes higher than the concentration of oxygen at the side surface given the negative polarity by a ratio corresponding to the potential difference. Further, as shown in FIG. 3 and FIG. 4A to FIG. 4C, at the air-fuel ratio sensor, a constant sensor applied voltage Vr is applied between the exhaust side electrode 52 and the atmosphere side electrode 53 so that the atmosphere side electrode 53 becomes the positive polarity and the exhaust side electrode 52 becomes the negative polarity. Note that, in the present embodiment, the sensor applied voltage Vr at the air-fuel ratio sensor becomes the same voltage.

When the exhaust air-fuel ratio around the air-fuel ratio sensor is leaner than the stoichiometric air-fuel ratio, the ratio of the oxygen concentration between the two side surfaces of the solid electrolyte layer 51 is not that large. For this reason, if setting the sensor applied voltage Vr to a suitable value, the actual oxygen concentration ratio between the two side surfaces of the solid electrolyte layer 51 becomes smaller than the oxygen concentration ratio corresponding to the sensor applied voltage Vr. For this reason, as shown in FIG. 4A, movement of oxygen ions occurs from the exhaust side electrode 52 toward the atmosphere side electrode 53 so that the oxygen concentration ratio between the two side surfaces of the solid electrolyte layer 51 becomes larger toward an oxygen concentration ratio corresponding to the sensor applied voltage Vr. As a result, current flows from the positive electrode of the voltage applying device 60 applying sensor applied voltage Vr to the negative electrode through the atmosphere side electrode 53, solid electrolyte layer 51, and exhaust side electrode 52.

The magnitude of the current (output current) Ir flowing at this time is proportional to the amount of oxygen flowing from the exhaust through the diffusion regulating layer 54 to the measured gas chamber 57 if setting the sensor applied voltage Vr to a suitable value. Therefore, by detecting the magnitude of this current Ir by the current detection device 61, it is possible to determine the concentration of oxygen and in turn possible to determine the air-fuel ratio in the lean region.

On the other hand, when the exhaust air-fuel ratio around the air-fuel ratio sensor is richer than the stoichiometric air-fuel ratio, unburned gas flows from inside the exhaust through the diffusion regulating layer 54 to the inside of the measured gas chamber 57, so even if there is oxygen on the exhaust side electrode 52, it reacts with the unburned gas to be removed. For this reason, inside the measured gas chamber 57, the concentration of oxygen becomes extremely low. As a result, the ratio of the concentration of oxygen between the two side surfaces of the solid electrolyte layer 51 becomes large. For this reason, if setting the sensor applied voltage Vr at a suitable value, between the two side surfaces of the solid electrolyte layer 51, the actual oxygen concentration ratio becomes larger than the oxygen concentration ratio corresponding to the sensor applied voltage Vr. For this reason, as shown in FIG. 4*b*, movement of oxygen ions occurs from the atmosphere side electrode 53 toward the exhaust side electrode 52 so that the ratio of oxygen concentration between the two side surfaces of the solid electrolyte layer 51 becomes smaller toward an oxygen concentration ratio corresponding to the sensor applied voltage Vr. As a result, current flows from the atmosphere side electrode 53 through the voltage applying device 60 applying sensor applied voltage Vr to the exhaust side electrode 52.

The current flowing at this time becomes the output current Ir. The magnitude of the output current is determined by the flow rate of the oxygen ions which are made to move inside the solid electrolyte layer 51 from the atmosphere side electrode 53 to the exhaust side electrode 52 if setting the sensor applied voltage Vr to a suitable value. On the exhaust side electrode 52, the oxygen ions react (burn) with the unburned gas flowing from the exhaust through the diffusion regulating layer 54 into the measured gas chamber 57 by diffusion. Accordingly, the flow rate of movement of the oxygen ions corresponds to the concentration of unburned gas in the exhaust gas flowing into the measured gas chamber 57. Therefore, by detecting the magnitude of this current Ir by the current detection device 61, it is possible to determine the concentration of unburned gas and in turn possible to determine the air-fuel ratio in the rich region.

Further, when the exhaust air-fuel ratio around the air-fuel ratio sensor is the stoichiometric air-fuel ratio, the amounts of oxygen and unburned gas flowing into the measured gas chamber 57 become the chemical equivalent ratio. For this reason, due to the catalytic action of the exhaust side electrode 52, the two completely burn and no fluctuation occurs in the concentrations of oxygen and unburned gas in the measured gas chamber 57. As a result of this, the oxygen concentration ratio between the two side surfaces of the solid electrolyte layer 51 does not fluctuate but is maintained at the oxygen concentration ratio corresponding to the sensor applied voltage Vr as is. For this reason, as shown in FIG. 4C, movement of the oxygen ions due to the oxygen pump property does not occur and as a result current flowing through the circuit is not produced.

Figure 5:
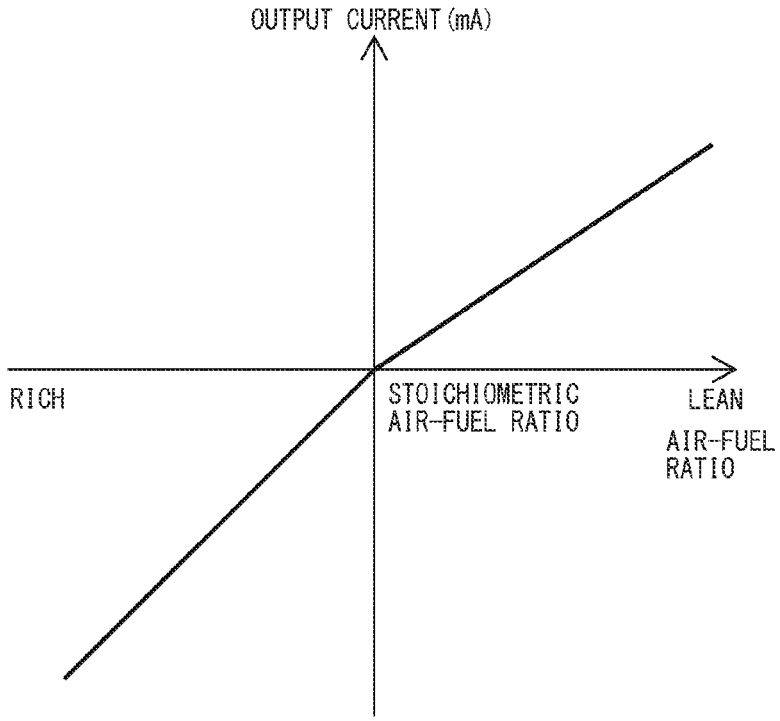
FIG. 5 is a view showing a relationship between an exhaust air-fuel ratio and output current at an air-fuel ratio sensor.

The thus configured air-fuel ratio sensor has the output characteristic shown in FIG. 5. That is, in the air-fuel ratio sensor, the larger the exhaust air-fuel ratio (that is, the leaner it becomes), the larger the output current of the air-fuel ratio sensor Ir. In addition, the air-fuel ratio sensor is configured so that the output current Ir becomes zero when the exhaust air-fuel ratio is the stoichiometric air-fuel ratio.

Circuits of Voltage Applying Device and Current Detection Device

Figure 6:
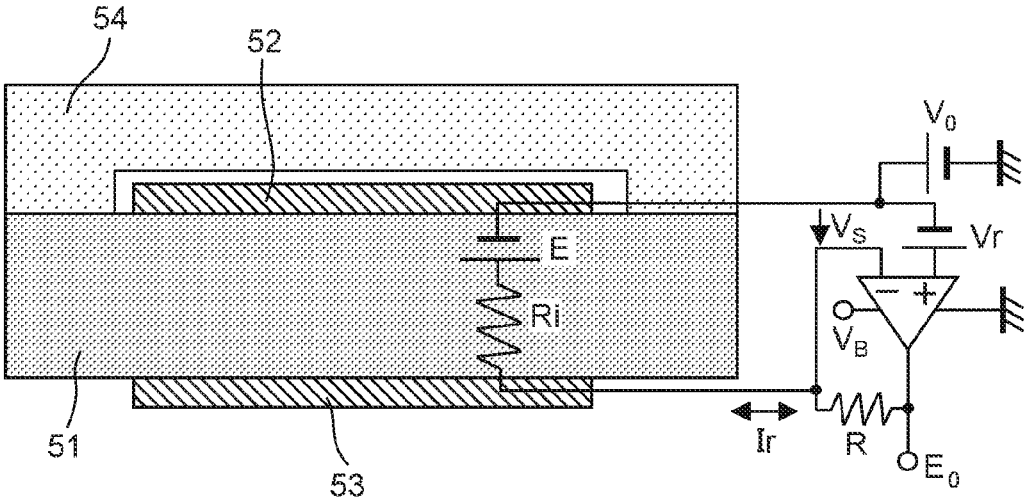
FIG. 6 is a view showing one example of specific circuits forming the voltage applying device and current detection device.

FIG. 6 shows one example of the specific circuits forming the voltage applying device 60 and current detection device 61. In the illustrated example, the electromotive force generated due to the oxygen cell characteristic is indicated as "E", the internal resistance of the solid electrolyte layer 51 is indicated as "Ri", and the potential difference between the exhaust side electrode 52 and the atmosphere side electrode 53 is indicated as "Vs".

As will be understood from FIG. 6, the voltage applying device 60 basically performs negative feedback control so that the electromotive force E which is generated due to the oxygen cell characteristic matches the sensor applied voltage Vr. In other words, the voltage applying device 60 performs negative feedback control so that the potential difference Vs becomes the sensor applied voltage Vr even if the potential difference Vs between the exhaust side electrode 52 and the atmosphere side electrode 53 changes due to a change in the oxygen concentration ratio between the two side surfaces of the solid electrolyte layer 51.

Therefore, if the exhaust air-fuel ratio becomes the stoichiometric air-fuel ratio and no change occurs in the oxygen concentration ratio between the two side surfaces of the solid electrolyte layer 51, the oxygen concentration ratio between the two side surfaces of the solid electrolyte layer 51 becomes an oxygen concentration ratio corresponding to the sensor applied voltage Vr. In this case, the electromotive force E matches the sensor applied voltage Vr, and the potential difference Vs between the exhaust side electrode 52 and the atmosphere side electrode 53 becomes the sensor applied voltage Vr. As a result, current Ir does not flow.

On the other hand, if the exhaust air-fuel ratio becomes an air-fuel ratio different from the stoichiometric air-fuel ratio and a change occurs in the oxygen concentration ratio between the two side surfaces of the solid electrolyte layer 51, the oxygen concentration ratio between the two side surfaces of the solid electrolyte layer 51 does not become an oxygen concentration ratio corresponding to the sensor applied voltage Vr. In this case, the electromotive force E becomes a value different from the sensor applied voltage Vr. For this reason, due to negative feedback control, a potential difference Vs is given between the exhaust side electrode 52 and the atmosphere side electrode 53 so as to make oxygen ions move between the two side surfaces of the solid electrolyte layer 51 so that the electromotive force E matches the sensor applied voltage Vr. Further, a current Ir flows along with movement of oxygen ions at this time. As a result of this, the electromotive force E converges to the sensor applied voltage Vr. If the electromotive force E converges to the sensor applied voltage Vr, finally, the potential difference Vs also converges to the sensor applied voltage Vr.

Therefore, the voltage applying device 60 can be said to substantially apply the sensor applied voltage Vr between the exhaust side electrode 52 and the atmosphere side electrode 53. Note that, the electrical circuit of the voltage applying device 60 does not necessarily have to be one such as shown in FIG. 6. The device may be any type so long as able to substantially apply the sensor applied voltage Vr between the exhaust side electrode 52 and the atmosphere side electrode 53.

Further, the current detection device 61 does not actually detect the current. It detects the voltage $E_0$ and calculates the current from this voltage $E_0$. Here, $E_0$ is expressed by the following formula (1).

$$E_0=Vr+V_0+IrR \quad (1)$$

Here, $V_0$ is the offset voltage (voltage applied so that $E_0$ does not become negative value, for example, 3V), and R is the value of the resistance shown in FIG. 6.

In formula (1), the sensor applied voltage Vr, offset voltage $V_0$, and resistance value R are constant, so the voltage $E_0$ changes according to the current Ir. For this reason, if detecting the voltage $E_0$, it is possible to calculate the current Ir from that voltage $E_0$.

Therefore, the current detection device 61 can be said to substantially detect the current Ir flowing between the exhaust side electrode 52 and the atmosphere side electrode 53. Note that, the electrical circuit of the current detection device 61 does not necessarily have to be one such as shown in FIG. 6. The device may be any type so long as able to detect the current Ir flowing between the exhaust side electrode 52 and the atmosphere side electrode 53.

Summary of Basic Normal Operation Control

Next, a summary of the air-fuel ratio control in the control system of an internal combustion engine of the present embodiment will be explained. First, the normal operation control for determining the fuel injection amount so that the gas air-fuel ratio is made to match the target air-fuel ratio in the internal combustion engine will be explained. The control system of an internal combustion engine is provided with an inflowing air-fuel ratio control means for adjusting the air-fuel ratio of the exhaust gas flowing into the exhaust purification catalyst. The inflowing air-fuel ratio control means of the present embodiment adjusts the amount of fuel supplied to a combustion chamber to thereby adjust the air-fuel ratio of the exhaust gas flowing into the exhaust purification catalyst. The inflowing air-fuel ratio control means is not limited to this. It is possible to employ any device able to adjust the air-fuel ratio of the exhaust gas flowing into the exhaust purification catalyst. For example, the inflowing air-fuel ratio control means may comprise an EGR (exhaust gas recirculation) device for recirculating exhaust gas to the engine intake passage and be formed so as to adjust the amount of recirculated gas.

The internal combustion engine of the present embodiment uses the output current Irup of the upstream side air-fuel ratio sensor 40 as the basis for feedback control so that the output current Irup of the upstream side air-fuel ratio sensor 40 (that is, the air-fuel ratio of the exhaust gas flowing into the exhaust purification catalyst) becomes a value corresponding to the target air-fuel ratio.

The target air-fuel ratio is set based on the output current of the downstream side air-fuel ratio sensor 41. Specifically, when the output current Irdwn of the downstream side air-fuel ratio sensor 41 becomes a rich judgment reference value Iref or less, the target air-fuel ratio is made a lean set air-fuel ratio and is maintained at that air-fuel ratio. Here, as the rich judgment reference value Iref, it is possible to use a value corresponding to a predetermined rich judged air-fuel ratio (for example, 14.55) slightly richer than the stoichiometric air-fuel ratio. Further, the lean set air-fuel ratio is a predetermined air-fuel ratio a certain extent leaner than the stoichiometric air-fuel ratio, for example, is made 14.65 to 20, preferably 14.65 to 18, more preferably 14.65 to 16 or so.

The control system of an internal combustion engine of the present embodiment is provided with an oxygen storage amount acquiring means for acquiring the amount of oxygen stored in the exhaust purification catalyst. When the target air-fuel ratio is the lean set air-fuel ratio, an oxygen storage amount OSAsc of the upstream side exhaust purification catalyst 20 is estimated. Further, in the present embodiment, the oxygen storage amount OSAsc of the upstream side exhaust purification catalyst 20 is estimated even when the target air-fuel ratio is the rich set air-fuel ratio. The oxygen storage amount OSAsc is estimated based on the output current Irup of the upstream side air-fuel ratio sensor 40, the estimated value of the intake air amount to the combustion chamber 5 calculated based on the air flowmeter 39 etc., the fuel injection amount from the fuel injector 11, etc. Further, during the time period when control is performed so that the target air-fuel ratio is set to the lean set air-fuel ratio, if the estimated value of the oxygen storage amount OSAsc becomes a predetermined judgment reference storage amount Cref or more, the target air-fuel ratio which had been the lean set air-fuel ratio up to then is made a rich set air-fuel ratio and is maintained at that air-fuel ratio. In the present embodiment, the weak rich set air-fuel ratio is employed. The weak rich set air-fuel ratio is slightly richer than the stoichiometric air-fuel ratio, for example, is made 13.5 to 14.58, preferably 14 to 14.57, more preferably 14.3 to 14.55 or so. After that, when the output current Irdwn of the downstream side air-fuel ratio sensor 41 again becomes the rich judgment reference value Iref or less, the target air-fuel ratio is again made the lean set air-fuel ratio and, after that, a similar operation is repeated.

In this way, in the present embodiment, the target air-fuel ratio of the exhaust gas flowing into the upstream side exhaust purification catalyst 20 is alternately set to the lean set air-fuel ratio and the weak rich set air-fuel ratio. In particular, in the present embodiment, the difference of the lean set air-fuel ratio from the stoichiometric air-fuel ratio is larger than the difference of the weak rich set air-fuel ratio from the stoichiometric air-fuel ratio. Therefore, in the present embodiment, the target air-fuel ratio is alternately set to a lean set air-fuel ratio of a short time period and a weak rich set air-fuel ratio of a long time period.

Note that, the difference of the lean set air-fuel ratio from the stoichiometric air-fuel ratio may be substantially the same as the difference of the rich set air-fuel ratio from the stoichiometric air-fuel ratio. That is, the depth of the rich set air-fuel ratio and the depth of the lean set air-fuel ratio may become substantially equal. In such a case, the time period of the lean set air-fuel ratio and the time period of the rich set air-fuel ratio become substantially the same lengths.

Explanation of Control Using Time Chart

Figure 7:
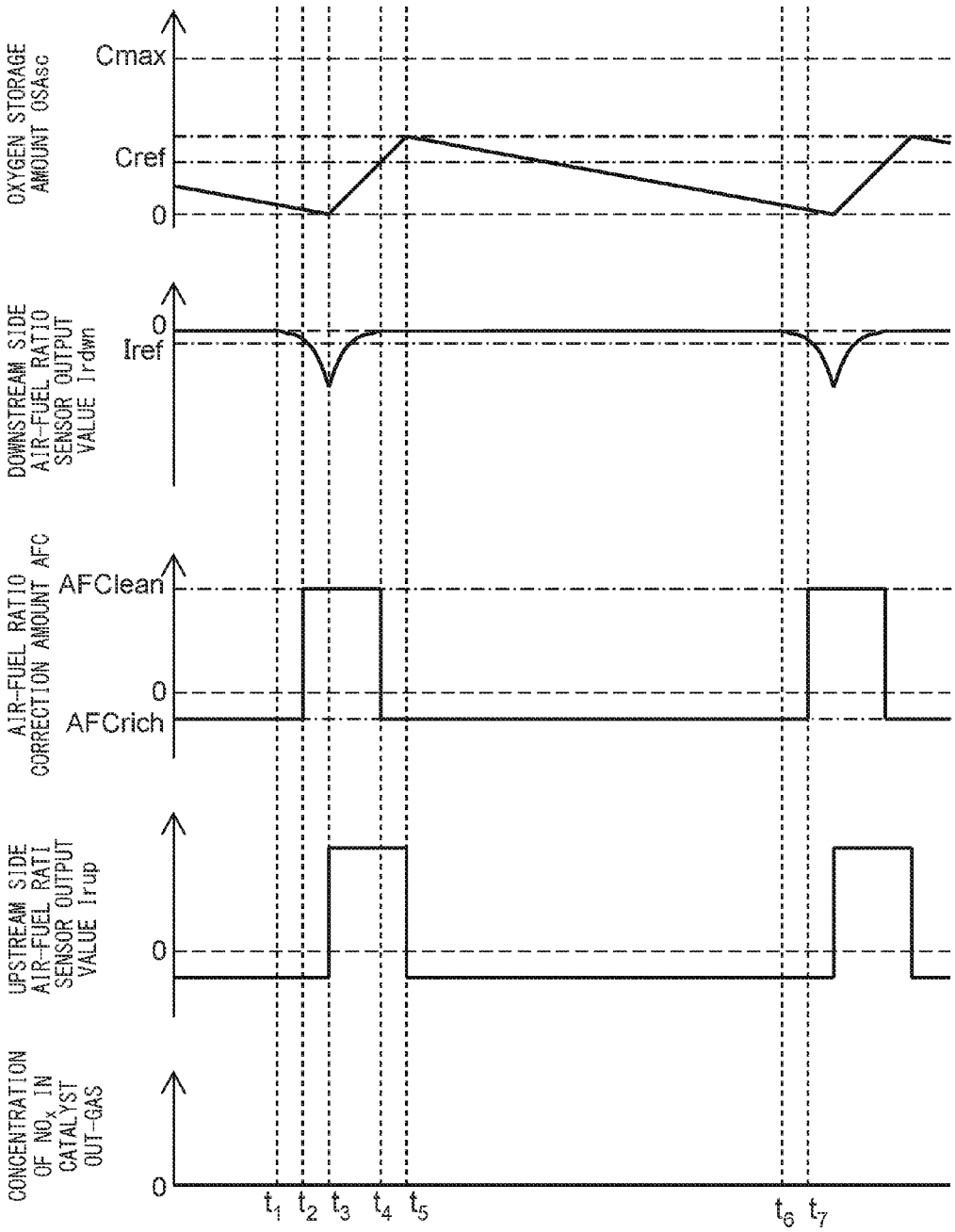
FIG. 7 is a time chart of an oxygen storage amount of an upstream side exhaust purification catalyst etc. in first normal operation control of an embodiment.

Referring to FIG. 7, the above explained operation will be specifically explained. FIG. 7 is a time chart of parameters in the case of performing air-fuel ratio control in a control system of an internal combustion engine of the present invention such as the oxygen storage amount OSAsc of the upstream side exhaust purification catalyst 20, output current Irdwn of the downstream side air-fuel ratio sensor 41, air-fuel ratio correction amount AFC, output current Irup of the upstream side air-fuel ratio sensor 40, and concentration of $NO_X$ in the exhaust gas flowing out from the upstream side exhaust purification catalyst 20.

Note that, the output current Irup of the upstream side air-fuel ratio sensor 40 becomes zero when the air-fuel ratio of the exhaust gas flowing into the upstream side exhaust purification catalyst 20 is the stoichiometric air-fuel ratio, becomes a negative value when the air-fuel ratio of the exhaust gas is a rich air-fuel ratio, and becomes a positive value when the air-fuel ratio of the exhaust gas is a lean air-fuel ratio. Further, when the air-fuel ratio of the exhaust gas flowing into the upstream side exhaust purification catalyst 20 is the rich air-fuel ratio or lean air-fuel ratio, the greater the difference from the stoichiometric air-fuel ratio, the greater the absolute value of the output current Irup of the upstream side air-fuel ratio sensor 40. The output current Irdwn of the downstream side air-fuel ratio sensor 41 also changes according to the air-fuel ratio of the exhaust gas flowing out from the upstream side exhaust purification catalyst 20 in the same way as the output current Irup of the upstream side air-fuel ratio sensor 40. Further, the air-fuel ratio correction amount AFC is the correction amount relating to the target air-fuel ratio of the exhaust gas flowing into the upstream side exhaust purification catalyst 20. When the air-fuel ratio correction amount AFC is 0, the target air-fuel ratio is made the stoichiometric air-fuel ratio, when the air-fuel ratio correction amount AFC is a positive value, the target air-fuel ratio becomes a lean air-fuel ratio, and when the air-fuel ratio correction amount AFC is a negative value, the target air-fuel ratio becomes the rich air-fuel ratio.

In the illustrated example, in the state before the time $t_1$, the air-fuel ratio correction amount AFC is made the weak rich set correction amount AFCrich. The weak rich set correction amount AFCrich is a value corresponding to the weak rich set air-fuel ratio and a value smaller than 0. Therefore, the target air-fuel ratio is made the rich air-fuel ratio. Along with this, the output current Irup of the upstream side air-fuel ratio sensor 40 becomes a negative value. If the exhaust gas flowing into the upstream side exhaust purification catalyst 20 starts to contain unburned gas, the oxygen storage amount OSAsc of the upstream side exhaust purification catalyst 20 gradually decreases. However, the unburned gas contained in the exhaust gas is removed at the upstream side exhaust purification catalyst 20, so the downstream side output current Irdwn of the air-fuel ratio sensor becomes substantially 0 (corresponding to stoichiometric air-fuel ratio). At this time, the air-fuel ratio of the exhaust gas flowing into the upstream side exhaust purification catalyst 20 becomes the rich air-fuel ratio, so the amount of discharge of $NO_X$ of the upstream side exhaust purification catalyst 20 is kept down.

If the oxygen storage amount OSAsc of the upstream side exhaust purification catalyst 20 gradually decreases, the oxygen storage amount OSAsc decreases below the lower limit storage amount (see Clowlim of FIG. 2B) at the time $t_1$. If the oxygen storage amount OSAsc decreases from the lower limit storage amount, part of the unburned gas flowing into the upstream side exhaust purification catalyst 20 flows out without being removed at the upstream side exhaust purification catalyst 20. For this reason, at the time $t_1$ on, along with the decrease of the oxygen storage amount OSAsc of the upstream side exhaust purification catalyst 20, the output current Irdwn of the downstream side air-fuel ratio sensor 41 gradually decreases. At this time as well, the air-fuel ratio of the exhaust gas flowing into the upstream side exhaust purification catalyst 20 becomes the rich air-fuel ratio, so the amount of discharge of $NO_X$ of the upstream side exhaust purification catalyst 20 is kept down.

After that, at the time $t_2$, the output current Irdwn of the downstream side air-fuel ratio sensor 41 reaches the rich judgment reference value Iref corresponding to the rich judged air-fuel ratio. In the present embodiment, if the output current Irdwn of the downstream side air-fuel ratio sensor 41 becomes the rich judgment reference value Iref, the decrease of the oxygen storage amount OSAsc of the upstream side exhaust purification catalyst 20 is kept down by the air-fuel ratio correction amount AFC being switched to the lean set correction amount AFClean. The lean set correction amount AFClean is a value corresponding to the lean set air-fuel ratio and is a value larger than 0. Therefore, the target air-fuel ratio is made the lean air-fuel ratio.

Note that, in the present embodiment, the air-fuel ratio correction amount AFC is switched after the output current Irdwn of the downstream side air-fuel ratio sensor 41 reaches the rich judgment reference value Iref, that is, after the air-fuel ratio of the exhaust gas flowing out from the upstream side exhaust purification catalyst 20 reaches the rich judged air-fuel ratio. This is because even if the oxygen storage amount of the upstream side exhaust purification catalyst 20 is sufficient, sometimes the air-fuel ratio of the exhaust gas flowing out from the upstream side exhaust purification catalyst 20 ends up deviating from the stoichiometric air-fuel ratio very slightly. That is, if ending up judging that the oxygen storage amount has decreased below the lower limit storage amount even if the output current Irdwn deviates from zero (corresponding to stoichiometric air-fuel ratio) slightly, there is a possibility that it will be judged that the oxygen storage amount has decreased below the lower limit storage amount even if there is actually a sufficient oxygen storage amount. Therefore, in the present embodiment, it is judged that the oxygen storage amount has decreased below the lower limit storage amount only after the air-fuel ratio of the exhaust gas flowing out from the upstream side exhaust purification catalyst 20 reaches the rich judged air-fuel ratio. Conversely speaking, the rich judged air-fuel ratio is made an air-fuel ratio which the air-fuel ratio of the exhaust gas flowing out from the upstream side exhaust purification catalyst 20 will not reach when the oxygen storage amount of the upstream side exhaust purification catalyst 20 is sufficient.

Even if, at the time $t_2$, switching the target air-fuel ratio to the lean air-fuel ratio, the air-fuel ratio of the exhaust gas flowing into the upstream side exhaust purification catalyst 20 does not immediately become the lean air-fuel ratio and a certain extent of delay occurs. As a result, the air-fuel ratio of the exhaust gas flowing into the upstream side exhaust purification catalyst 20 changes from the rich air-fuel ratio to the lean air-fuel ratio at the time $t_3$. Note that, at the times $t_2$ to $t_3$, the air-fuel ratio of the exhaust gas flowing out from the upstream side exhaust purification catalyst 20 becomes the rich air-fuel ratio, so this exhaust gas starts to contain unburned gas. However, the amount of discharge of $NO_X$ of the upstream side exhaust purification catalyst 20 is suppressed.

If, at the time $t_3$, the air-fuel ratio of the exhaust gas flowing into the upstream side exhaust purification catalyst 20 changes to the lean air-fuel ratio, the oxygen storage amount OSAsc of the upstream side exhaust purification catalyst 20 increases. Further, along with this, the air-fuel ratio of the exhaust gas flowing out from the upstream side exhaust purification catalyst 20 changes to the stoichiometric air-fuel ratio and the output current Irdwn of the downstream side air-fuel ratio sensor 41 also converges to 0. At this time, the air-fuel ratio of the exhaust gas flowing into the upstream side exhaust purification catalyst 20 becomes the lean air-fuel ratio, so there is sufficient extra margin in the oxygen storage ability of the upstream side exhaust purification catalyst 20, so the oxygen in the inflowing exhaust gas is stored in the upstream side exhaust purification catalyst 20 and $NO_X$ is removed by reduction. For this reason, the amount of discharge of $NO_X$ of the upstream side exhaust purification catalyst 20 is kept down.

After that, if the oxygen storage amount OSAsc of the upstream side exhaust purification catalyst 20 increases, at the time $t_4$, the oxygen storage amount OSAsc reaches the judgment reference storage amount Cref. In the present embodiment, if the oxygen storage amount OSAsc becomes the judgment reference storage amount Cref, the storage of oxygen in the upstream side exhaust purification catalyst 20 is made to stop by making the air-fuel ratio correction amount AFC switch to the weak rich set correction amount AFCrich (value smaller than 0). Therefore, the target air-fuel ratio is made the rich air-fuel ratio.

However, as explained above, a delay occurs from when switching the target air-fuel ratio to when the air-fuel ratio of the exhaust gas flowing into the upstream side exhaust purification catalyst 20 actually changes. For this reason, even if switching at the time $t_4$, the air-fuel ratio of the exhaust gas flowing into the upstream side exhaust purification catalyst 20 changes from the lean air-fuel ratio to the rich air-fuel ratio at the time $t_5$ after a certain extent of time elapses. At the times $t_4$ to $t_5$, the air-fuel ratio of the exhaust gas flowing into the upstream side exhaust purification catalyst 20 is the lean air-fuel ratio, so the oxygen storage amount OSAsc of the upstream side exhaust purification catalyst 20 increases.

However, the judgment reference storage amount Cref is set sufficiently lower than the maximum oxygen storage amount Cmax and the upper limit storage amount (see Cuplim of FIG. 2A), so even at the time $t_5$, the oxygen storage amount OSAsc does not reach the maximum oxygen storage amount Cmax or the upper limit storage amount. Conversely speaking, the judgment reference storage amount Cref is made an amount sufficiently small so that even if a delay occurs from when switching the target air-fuel ratio to when the air-fuel ratio of the exhaust gas flowing into the upstream side exhaust purification catalyst 20 actually changes, the oxygen storage amount OSAsc does not reach the maximum oxygen storage amount Cmax or the upper limit storage amount. For example, the judgment reference storage amount Cref is made ¾ or less of the maximum oxygen storage amount Cmax, preferably ½ or less, more preferably ⅕ or less. Therefore, at the times $t_4$ to $t_5$, the amount of discharge of $NO_X$ from the upstream side exhaust purification catalyst 20 is kept down.

At the time $t_5$ on, the air-fuel ratio correction amount AFC is made the weak rich set correction amount AFCrich. Therefore, the target air-fuel ratio is made the rich air-fuel ratio. Along with this, the output current Irup of the upstream side air-fuel ratio sensor 40 becomes a negative value. The exhaust gas flowing into the upstream side exhaust purification catalyst 20 starts to contain unburned gas, so the oxygen storage amount OSAsc of the upstream side exhaust purification catalyst 20 gradually decreases and, at the time $t_6$, in the same way as the time $t_1$, the oxygen storage amount OSAsc decreases below the lower limit storage amount. At this time as well, the air-fuel ratio of the exhaust gas flowing into the upstream side exhaust purification catalyst 20 is the rich air-fuel ratio, so the amount of discharge of $NO_X$ of the upstream side exhaust purification catalyst 20 is kept down.

Next, at the time $t_7$, in the same way as the time $t_2$, the output current Irdwn of the downstream side air-fuel ratio sensor 41 reaches the rich judgment reference value Iref corresponding to the rich judged air-fuel ratio. Due to this, the air-fuel ratio correction amount AFC is switched to the lean set correction amount AFClean corresponding to the lean set air-fuel ratio. After that, the cycle of the above-mentioned times $t_1$ to $t_6$ is repeated.

Note that, such control of the air-fuel ratio correction amount AFC is performed by the electronic control unit 31. Therefore, the electronic control unit 31 can be said to be provided with an oxygen storage amount increasing means for continuously making the target air-fuel ratio of the exhaust gas flowing into the upstream side exhaust purification catalyst 20 the lean set air-fuel ratio when the air-fuel ratio of the exhaust gas detected by the downstream side air-fuel ratio sensor 41 becomes the rich judged air-fuel ratio or less until the oxygen storage amount OSAsc of the upstream side exhaust purification catalyst 20 becomes the judgment reference storage amount Cref, and an oxygen storage amount decreasing means for continuously making the target air-fuel ratio the weak rich set air-fuel ratio when the oxygen storage amount OSAsc of the upstream side exhaust purification catalyst 20 becomes the judgment reference storage amount Cref or more so that the oxygen storage amount OSAsc decreases toward zero without reaching the maximum oxygen storage amount Cmax.

As will be understood from the above explanation, according to the present embodiment, it is possible to constantly keep down the amount of discharge of $NO_X$ from the upstream side exhaust purification catalyst 20. That is, so long as performing the above-mentioned control, basically it is possible to reduce the amount of discharge of $NO_X$ from the upstream side exhaust purification catalyst 20.

Further, in general, when the output current Irup of the upstream side air-fuel ratio sensor 40 and the estimated value of the intake air amount etc. are used as the basis to estimate the oxygen storage amount OSAsc, error may occur. In the present embodiment as well, the oxygen storage amount OSAsc is estimated over the times $t_3$ to $t_4$, so the estimated value of the oxygen storage amount OSAsc includes some error. However, even if such error is included, if setting the judgment reference storage amount Cref sufficiently lower than the maximum oxygen storage amount Cmax or the upper limit storage amount, the actual oxygen storage amount OSAsc almost never reaches the maximum oxygen storage amount Cmax or the upper limit storage amount. Therefore, from this viewpoint as well, it is possible to keep down the amount of discharge of $NO_X$ of the upstream side exhaust purification catalyst 20.

Further, if the oxygen storage amount of the exhaust purification catalyst is maintained constant, the oxygen storage ability of the exhaust purification catalyst will fall. As opposed to this, according to the present embodiment, the oxygen storage amount OSAsc constantly fluctuates up and down, so the oxygen storage ability is kept from falling.

Note that, in the above embodiment, at the times $t_2$ to $t_4$, the air-fuel ratio correction amount AFC is maintained at the lean set correction amount AFClean. However, in this time period, the air-fuel ratio correction amount AFC does not necessarily have to be maintained constant. It may also be set so as to fluctuate such as so as to gradually decrease. In the same way, at the times $t_4$ to $t_7$, the air-fuel ratio correction amount AFC is maintained at the weak rich set correction amount AFCrich. However, in this time period, the air-fuel ratio correction amount AFC does not necessarily have to be maintained constant. It may also be set so as to fluctuate such as so as to gradually decrease.

However, in this case as well, the air-fuel ratio correction amount AFC at the times $t_2$ to $t_4$ may be set so that the difference between the average value of the target air-fuel ratio at that time period and the stoichiometric air-fuel ratio becomes larger than the difference between the average value of the target air-fuel ratio at the times $t_4$ to $t_7$ and the stoichiometric air-fuel ratio.

Further, in the above embodiment, the output current Irup of the upstream side air-fuel ratio sensor 40 and the estimated value of the intake air amount to a combustion chamber 5 etc. are used as the basis to estimate the oxygen storage amount OSAsc of the upstream side exhaust purification catalyst 20. However, the oxygen storage amount OSAsc may also be calculated based on other parameters besides these parameters. Parameters different from these parameters may also be used as the basis for estimation. Further, in the above embodiment, if the estimated value of the oxygen storage amount OSAsc becomes a judgment reference storage amount Cref or more, the target air-fuel ratio is switched from the lean set air-fuel ratio to the weak rich set air-fuel ratio. However, the timing for switching the target air-fuel ratio from the lean set air-fuel ratio to the weak rich set air-fuel ratio may, for example, also be based on the engine operating time from when switching the target air-fuel ratio from the weak rich set air-fuel ratio to the lean set air-fuel ratio or another parameter. However, in this case as well, the target air-fuel ratio has to be switched from the lean set air-fuel ratio to the weak rich set air-fuel ratio while the oxygen storage amount OSAsc of the upstream side exhaust purification catalyst 20 is estimated as being smaller than the maximum oxygen storage amount.

Explanation of Control Using Downstream Side Catalyst

Further, in the present embodiment, in addition to the upstream side exhaust purification catalyst 20, a downstream side exhaust purification catalyst 24 is also provided. The oxygen storage amount OSAufc of the downstream side exhaust purification catalyst 24 is made a value near the maximum oxygen storage amount Cmax by fuel cut (F/C) control performed every certain extent of time period. For this reason, even if exhaust gas containing unburned gas flows out from the upstream side exhaust purification catalyst 20, the unburned gas is removed by oxidation at the downstream side exhaust purification catalyst 24.

Here, "fuel cut control" is control for stopping the injection of fuel from the fuel injector 11 at the time of deceleration of the vehicle mounting the internal combustion engine etc. even in a state where the crankshaft and piston 3 are moving. If performing this control, a large amount of air flows into the exhaust purification catalyst 20 and exhaust purification catalyst 24.

Figure 8:
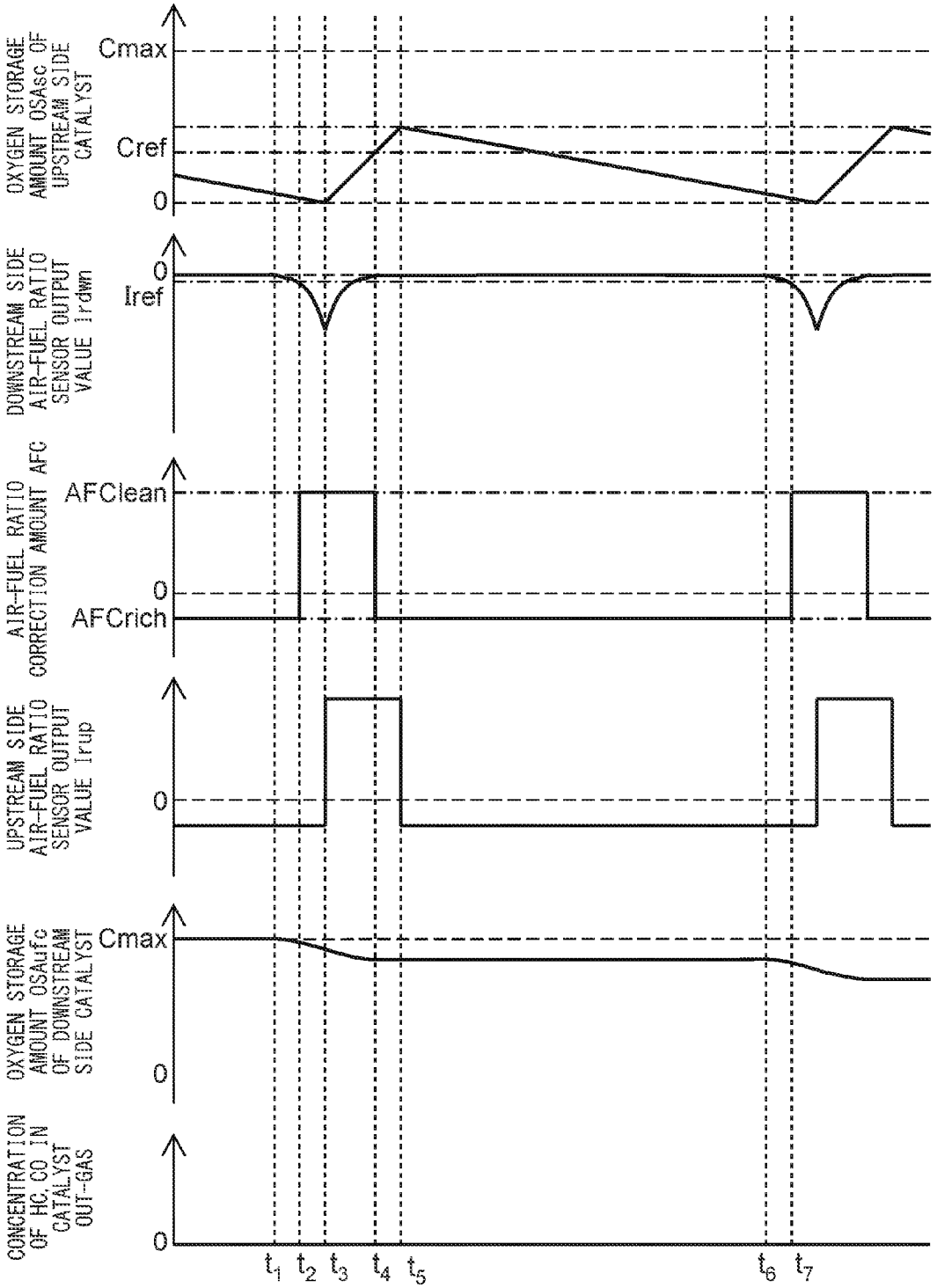
FIG. 8 is a time chart of an oxygen storage amount of a downstream side exhaust purification catalyst etc. in first normal operation control of an embodiment.

Below, referring to FIG. 8, the trend in the oxygen storage amount OSAufc at the downstream side exhaust purification catalyst 24 will be explained. FIG. 8 is a view similar to FIG. 7. Instead of the concentration of $NO_X$ of FIG. 7, this shows the trends in the oxygen storage amount OSAufc of the downstream side exhaust purification catalyst 24 and the concentration of the unburned gas in the exhaust gas (HC, CO, etc. flowing out from the downstream side exhaust purification catalyst 24. Further, in the example shown in FIG. 8, control the same as the example shown in FIG. 7 is performed.

In the example shown in FIG. 8, before the time $t_1$, fuel cut control is performed. For this reason, before the time $t_1$, the oxygen storage amount OSAufc of the downstream side exhaust purification catalyst 24 becomes a value near the maximum oxygen storage amount Cmax. Further, before the time $t_1$, the air-fuel ratio of the exhaust gas flowing out from the upstream side exhaust purification catalyst 20 is maintained at substantially the stoichiometric air-fuel ratio. For this reason, the oxygen storage amount OSAufc of the downstream side exhaust purification catalyst 24 is maintained constant.

After that, at the times $t_1$ to $t_4$, the air-fuel ratio of the exhaust gas flowing out from the upstream side exhaust purification catalyst 20 becomes the rich air-fuel ratio. For this reason, exhaust gas including unburned gas flows into the downstream side exhaust purification catalyst 24.

As explained above, the downstream side exhaust purification catalyst 24 stores a large amount of oxygen, so if the exhaust gas flowing into the downstream side exhaust purification catalyst 24 contains unburned gas, the stored oxygen enables the unburned gas to be removed by oxidation. Further, along with this, the oxygen storage amount OSAufc of the downstream side exhaust purification catalyst 24 will decrease. However, at the times $t_1$ to $t_4$, the unburned gas flowing out from the upstream side exhaust purification catalyst 20 does not become that great, so the amount of decrease of the oxygen storage amount OSAufc during this period is slight. For this reason, at the times $t_1$ to $t_4$, the unburned gas flowing out from the upstream side exhaust purification catalyst 20 is all removed by reduction at the downstream side exhaust purification catalyst 24.

At the time $t_6$ on as well, every certain extent of time interval, in the same way as the case at the times $t_1$ to $t_4$, unburned gas flows out from the upstream side exhaust purification catalyst 20. The thus flowing out unburned gas is basically removed by reduction by the oxygen stored in the downstream side exhaust purification catalyst 24. Therefore, almost no unburned gas flows out from the downstream side exhaust purification catalyst 24. As explained above, if considering the fact that the amount of discharge of $NO_X$ of the upstream side exhaust purification catalyst 20 is made small, according to the present embodiment, the amounts of discharge of unburned gas and $NO_X$ from the downstream side exhaust purification catalyst 24 are made constantly small.

Specific Explanation of Control

Figure 9:
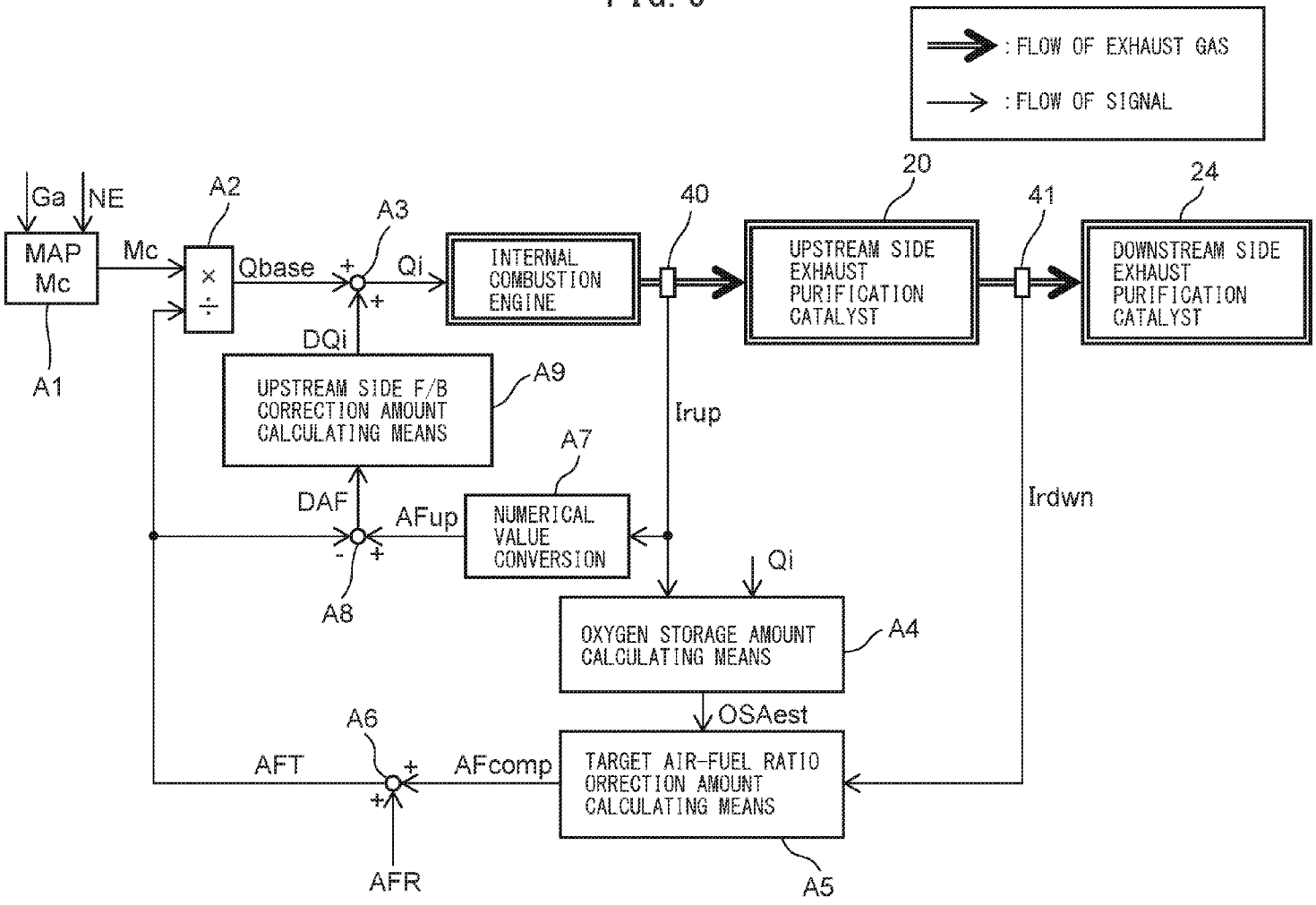
FIG. 9 is a functional block diagram of a control system.
Figure 10:
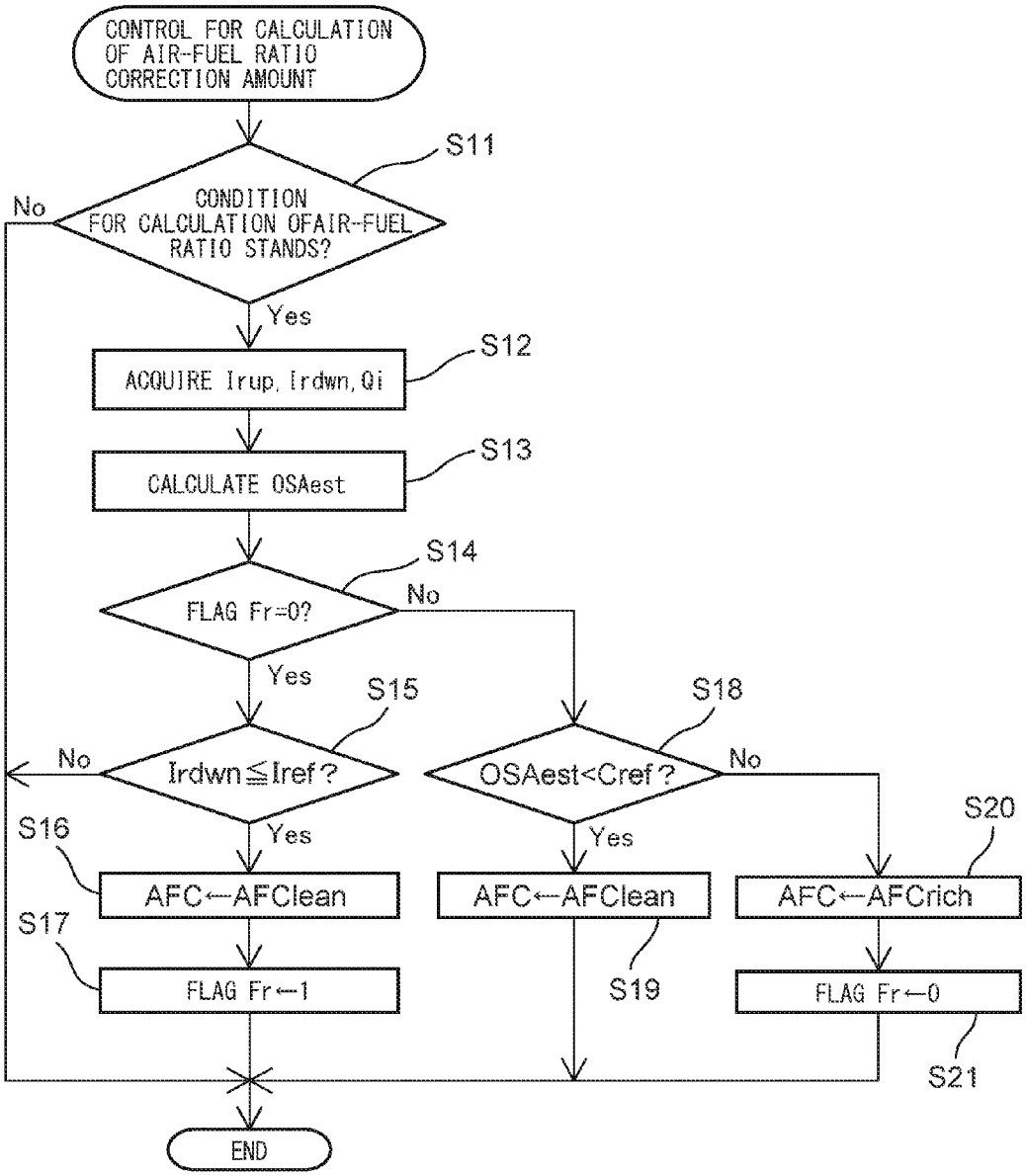
FIG. 10 is a flow chart of a control routine for calculating an air-fuel ratio correction amount in a first normal operation control of an embodiment.

Next, referring to FIG. 9 and FIG. 10, the control system in the above embodiment will be specifically explained. The control system in the present embodiment is, as shown in the functional block diagram of FIG. 9, configured including the functional blocks A1 to A9. Below, while referring to FIG. 9, the functional blocks will be explained.

Calculation of Fuel Injection Amount

First, calculation of the fuel injection amount will be explained. In calculating the fuel injection amount, a cylinder intake air amount calculating means A1 functioning as a cylinder intake air amount calculating part, a basic fuel injection amount calculating means A2 functioning as a basic fuel injection amount calculating part, and a fuel injection amount calculating means A3 functioning as a fuel injection amount calculating part are used.

The cylinder intake air amount calculating means A1 uses an intake air flow rate Ga measured by the air flowmeter 39, an engine speed NE calculated based on the output of the crank angle sensor 44, and a map or calculation formula stored in the ROM 34 of the electronic control unit 31 as the basis to calculate the intake air amount Mc to each cylinder. In the present embodiment, the cylinder intake air amount calculating means A1 functions as the intake air amount acquiring means. The intake air amount acquiring means is not limited to this. Any device or control may be used to acquire the intake air amount of air flowing into a combustion chamber.

The basic fuel injection amount calculating means A2 divides the cylinder intake air amount Mc calculated by the cylinder intake air amount calculating means A1 by the target air-fuel ratio AFT calculated by the later explained target air-fuel ratio setting means A6 to thereby calculate the basic fuel injection amount Qbase (Qbase=Mc/AFT).

The fuel injection amount calculating means A3 adds the later explained F/B correction amount DQi to the basic fuel injection amount Qbase calculated by the basic fuel injection amount calculating means A2 to thereby calculate the fuel injection amount Qi (Qi=Qbase+DQi). The fuel injector 11 is given an injection command so that the thus calculated fuel injection amount Qi of fuel is injected from the fuel injector 11.

Calculation of Target Air-Fuel Ratio

Next, the calculation of the target air-fuel ratio will be explained. In calculation of the target air-fuel ratio, the oxygen storage amount acquiring means is used as the oxygen storage amount acquiring part. In calculating the target air-fuel ratio, the oxygen storage amount calculating means A4 functioning as the oxygen storage amount acquiring part, the target air-fuel ratio correction amount calculating means A5 functioning as the target air-fuel ratio correction amount calculating part, and the target air-fuel ratio setting means A6 functioning as the target air-fuel ratio setting part are used.

The oxygen storage amount calculating means A4 uses the fuel injection amount Qi calculated by the fuel injection amount calculating means A3 and the output current Irup of the upstream side air-fuel ratio sensor 40 as the basis to calculate the estimated value OSAest of the oxygen storage amount of the upstream side exhaust purification catalyst 20. For example, the oxygen storage amount calculating means A4 multiplies the difference between the air-fuel ratio corresponding to the output current Irup of the upstream side air-fuel ratio sensor 40 and the stoichiometric air-fuel ratio with the fuel injection amount Qi, and cumulatively adds the calculated values to calculate the estimated value OSAest of the oxygen storage amount. Further, the fuel injection amount Qi and the output current Irup of the upstream side air-fuel ratio sensor 40 may be used as the basis to calculate the amount of release of oxygen. Note that, the oxygen storage amount of the upstream side exhaust purification catalyst 20 need not be estimated by the oxygen storage amount calculating means A4 constantly. For example, the oxygen storage amount may be estimated only for the period from when the target air-fuel ratio is actually switched from the rich air-fuel ratio to the lean air-fuel ratio (time $t_3$ at FIG. 7) to when the estimated value OSAest of the oxygen storage amount reaches the judgment reference storage amount Cref (time $t_4$ at FIG. 7).

The target air-fuel ratio correction amount calculating means A5 uses the estimated value OSAest of the oxygen storage amount calculated by the oxygen storage amount calculating means A4 and the output current Irdwn of the downstream side air-fuel ratio sensor 41 as the basis to calculate the air-fuel ratio correction amount AFC of the target air-fuel ratio. Specifically, the air-fuel ratio correction amount AFC is made the lean set correction amount AFClean when the output current Irdwn of the downstream side air-fuel ratio sensor 41 becomes the rich judgment reference value Iref (value corresponding to rich judged air-fuel ratio) or less. After that, the air-fuel ratio correction amount AFC is maintained at the lean set correction amount AFClean until the estimated value OSAest of the oxygen storage amount reaches the judgment reference storage amount Cref. If the estimated value OSAest of the oxygen storage amount reaches the judgment reference storage amount Cref, the air-fuel ratio correction amount AFC is made the weak rich set correction amount AFCrich. After that, the air-fuel ratio correction amount AFC is maintained at the weak rich set correction amount AFCrich until the output current Irdwn of the downstream side air-fuel ratio sensor 41 becomes the rich judgment reference value Iref (value corresponding to rich judged air-fuel ratio).

The target air-fuel ratio setting means A6 calculates the target air-fuel ratio AFT by adding an air-fuel ratio correction amount AFC calculated by the target air-fuel ratio correction amount calculating means A5 to the reference air-fuel ratio, in the present embodiment, the stoichiometric air-fuel ratio AFR. Therefore, the target air-fuel ratio AFT is made either the weak rich set air-fuel ratio (when the air-fuel ratio correction amount AFC is the weak rich set correction amount AFCrich) or the lean set air-fuel ratio (when the air-fuel ratio correction amount AFC is the lean set correction amount AFClean). The thus calculated target air-fuel ratio AFT is input to the basic fuel injection amount calculating means A2 and the later explained air-fuel ratio difference calculating means A8.

FIG. 10 is a flow chart showing a control routine of control for calculating the air-fuel ratio correction amount AFC. The illustrated control routine is performed by interruption at constant time intervals.

As shown in FIG. 10, first, at step S11, it is judged if the condition for calculation of the air-fuel ratio correction amount AFC stands. The case where the condition for calculation of the air-fuel ratio correction amount stands is, for example, when fuel cut control is not underway etc. If at step S11 it is judged that the condition for calculation of the target air-fuel ratio stands, the routine proceeds to step S12. At step S12, the output current Irup of the upstream side air-fuel ratio sensor 40, the output current Irdwn of the downstream side air-fuel ratio sensor 41, and the fuel injection amount Qi are obtained. At the next step S13, the output current Irup of the upstream side air-fuel ratio sensor 40 and the fuel injection amount Qi obtained at step S12 are used as the basis to calculate the estimated value OSAest of the oxygen storage amount.

Next, at step S14, it is judged if the lean set flag Fr is set to "0". The lean set flag Fr is set to "1" if the air-fuel ratio correction amount AFC is set to the lean set correction amount AFClean and is set to "0" otherwise. When at step S14 the lean set flag Fr is set to "0", the routine proceeds to step S15. At step S15, it is judged if the output current Irdwn of the downstream side air-fuel ratio sensor 41 is the rich judgment reference value Iref or less. If it is judged that the output current Irdwn of the downstream side air-fuel ratio sensor 41 is larger than the rich judgment reference value Iref, the control routine is made to end.

On the other hand, if the oxygen storage amount OSAsc of the upstream side exhaust purification catalyst 20 decreases and the air-fuel ratio of the exhaust gas flowing out from the upstream side exhaust purification catalyst 20 falls, at step S15, it is judged that the output current Irdwn of the downstream side air-fuel ratio sensor 41 is the rich judgment reference value Iref or less. In this case, the routine proceeds to step S16 where air-fuel ratio correction amount AFC is made the lean set correction amount AFClean. Next, at step S17, the lean set flag Fr is set to "1", and the control routine is made to end.

At the next control routine, at step S14, it is judged that the lean set flag Fr has not been set to "0" and the routine proceeds to step S18. At step S18, it is judged if the estimated value OSAest of the oxygen storage amount calculated at step S13 is smaller than the judgment reference storage amount Cref. When it is judged that the estimated value OSAest of the oxygen storage amount is smaller than the judgment reference storage amount Cref, the routine proceeds to step S19 where the air-fuel ratio correction amount AFC continues to be made the lean set correction amount AFClean. On the other hand, if the oxygen storage amount of the upstream side exhaust purification catalyst 20 increases, finally at step S18 it is judged that the estimated value OSAest of the oxygen storage amount is the judgment reference storage amount Cref or more and the routine proceeds to step S20. At step S20, the air-fuel ratio correction amount AFC is made the weak rich set correction amount AFCrich, next, at step S21, the lean set flag Fr is reset to 0, then the control routine is made to end.

Calculation of F/B Correction Amount

Next, returning to FIG. 9, the calculation of the F/B correction amount based on the output current Irup of the upstream side air-fuel ratio sensor 40 will be explained. In calculation of the F/B correction amount, a numerical value converting part constituted by the numerical value converting means A7, an air-fuel ratio difference calculating part constituted by the air-fuel ratio difference calculating means A8, and a F/B correction amount calculating part constituted by the F/B correction amount calculating means A9 are used.

The numerical value converting means A7 uses the output current Irup of the upstream side air-fuel ratio sensor 40 and a map or calculation formula (for example, the map such as shown in FIG. 5) defining the relationship between the output current Irup of the upstream side air-fuel ratio sensor 40 and the air-fuel ratio as the basis to calculate the upstream side exhaust air-fuel ratio AFup corresponding to the output current Irup. Therefore, the upstream side exhaust air-fuel ratio AFup corresponds to the air-fuel ratio of the exhaust gas flowing into the upstream side exhaust purification catalyst 20.

The air-fuel ratio difference calculating means A8 subtracts from the upstream side exhaust air-fuel ratio AFup calculated by the numerical value converting means A7 the target air-fuel ratio AFT calculated by the target air-fuel ratio setting means A6 to thereby calculate the air-fuel ratio difference DAF (DAF=AFup−AFT). This air-fuel ratio difference DAF is a value expressing the excess/deficiency of the amount of fuel fed with respect to the target air-fuel ratio AFT.

The F/B correction calculating means A9 processes the air-fuel ratio difference DAF calculated by the air-fuel ratio difference calculating means A8 by proportional-integral-differential (PID) processing to calculate the F/B correction amount DFi for compensating for the excess/deficiency of the amount of feed of fuel based on the following formula (2). The thus calculated F/B correction amount DFi is input to the fuel injection calculating means A3.

$$DFi=Kp\cdot DAF+Ki\cdot SDAF+Kd\cdot DDAF \quad (2)$$

Note that, in the above formula (2), Kp is a preset proportional gain (proportional constant), Ki is a preset integral gain (integral constant), and Kd is a preset differential gain (differential constant). Further, DDAF is the time differential of the air-fuel ratio difference DAF and is calculated by dividing the difference between the currently updated air-fuel ratio difference DAF and the previously updated air-fuel ratio difference DAF by the time corresponding to the updating interval. Further, SDAF is the time integral of the air-fuel ratio difference DAF. This time integral DDAF is calculated by adding the previously updated time integral DDAF and the currently updated air-fuel ratio difference DAF (SDAF=DDAF+DAF).

Note that, in the above embodiment, the air-fuel ratio of the exhaust gas flowing into the upstream side exhaust purification catalyst 20 is detected by the upstream side air-fuel ratio sensor 40. However, the precision of detection of the air-fuel ratio of the exhaust gas flowing into the upstream side exhaust purification catalyst 20 does not necessarily have to be high, so, for example, the fuel injection amount from the fuel injector 11 and the output of the air flowmeter 39 may be used as the basis to estimate the air-fuel ratio of the exhaust gas.

In this way, in normal operation control, by performing control to make the air-fuel ratio of the exhaust gas flowing into the upstream side exhaust purification catalyst repeatedly the state of a rich air-fuel ratio and the state of a lean air-fuel ratio and further avoid the oxygen storage amount reaching the vicinity of the maximum oxygen storage amount, it is possible to keep $NO_X$ from flowing out. In the present embodiment, in normal operation control, control for making the air-fuel ratio of the exhaust gas flowing into the upstream side exhaust purification catalyst 20 a rich air-fuel ratio will be referred to as "rich control", while control for making the air-fuel ratio of the exhaust gas flowing into the exhaust purification catalyst 20 a lean air-fuel ratio will be referred to as the "lean control". That is, in normal operation control, rich control and lean control are repeatedly performed. Further, the above-mentioned basic normal operation control will be referred to as the "first normal operation control".

Explanation of Second Normal Operation Control Next, a second normal operation control in the present embodiment will be explained. During the operating time period of the internal combustion engine, the requested load changes. The control system of the internal combustion engine adjusts the intake air amount based on the requested load. That is, the larger the load becomes, the intake air amount is increased. The amount of fuel injected from the fuel injector is set based on the intake air amount and the air-fuel ratio at the time of combustion.

In this regard, even if the air-fuel ratio at the time of combustion is the same, if the intake air amount increases, the flow rate of the exhaust gas flowing into the exhaust purification catalyst increases. If the air-fuel ratio of the exhaust gas is the lean air-fuel ratio, the more the intake air amount increases, the more the amount of oxygen flowing into the exhaust purification catalyst per unit time increases. For this reason, in the operating state where the intake air amount becomes larger, the speed of change of the oxygen storage amount of the exhaust purification catalyst becomes greater. The air-fuel ratio at the time of combustion includes predetermined error when changing along with fluctuations in load etc. Due to the deviation of the air-fuel ratio at the time of combustion etc., deviation also occurs in the air-fuel ratio of the exhaust gas flowing into the exhaust purification catalyst. At this time, even if the air-fuel ratio of the exhaust gas is small, if the flow rate of exhaust gas is large, the speed of increase of the oxygen storage amount becomes faster and the oxygen storage amount is liable to approach the maximum oxygen storage amount Cmax of the exhaust purification catalyst. If the oxygen storage amount approaches the maximum oxygen storage amount Cmax of the exhaust purification catalyst, the $NO_X$ is liable to be unable to be sufficiently removed.

Therefore, in the second normal operation control of the present embodiment, control is performed to acquire the intake air amount and the intake air amount is used as the basis to change the lean set air-fuel ratio at the lean control.

In the second normal operation control, control is included to set the lean set air-fuel ratio to the rich side the more the intake air amount increases.

Figure 11:
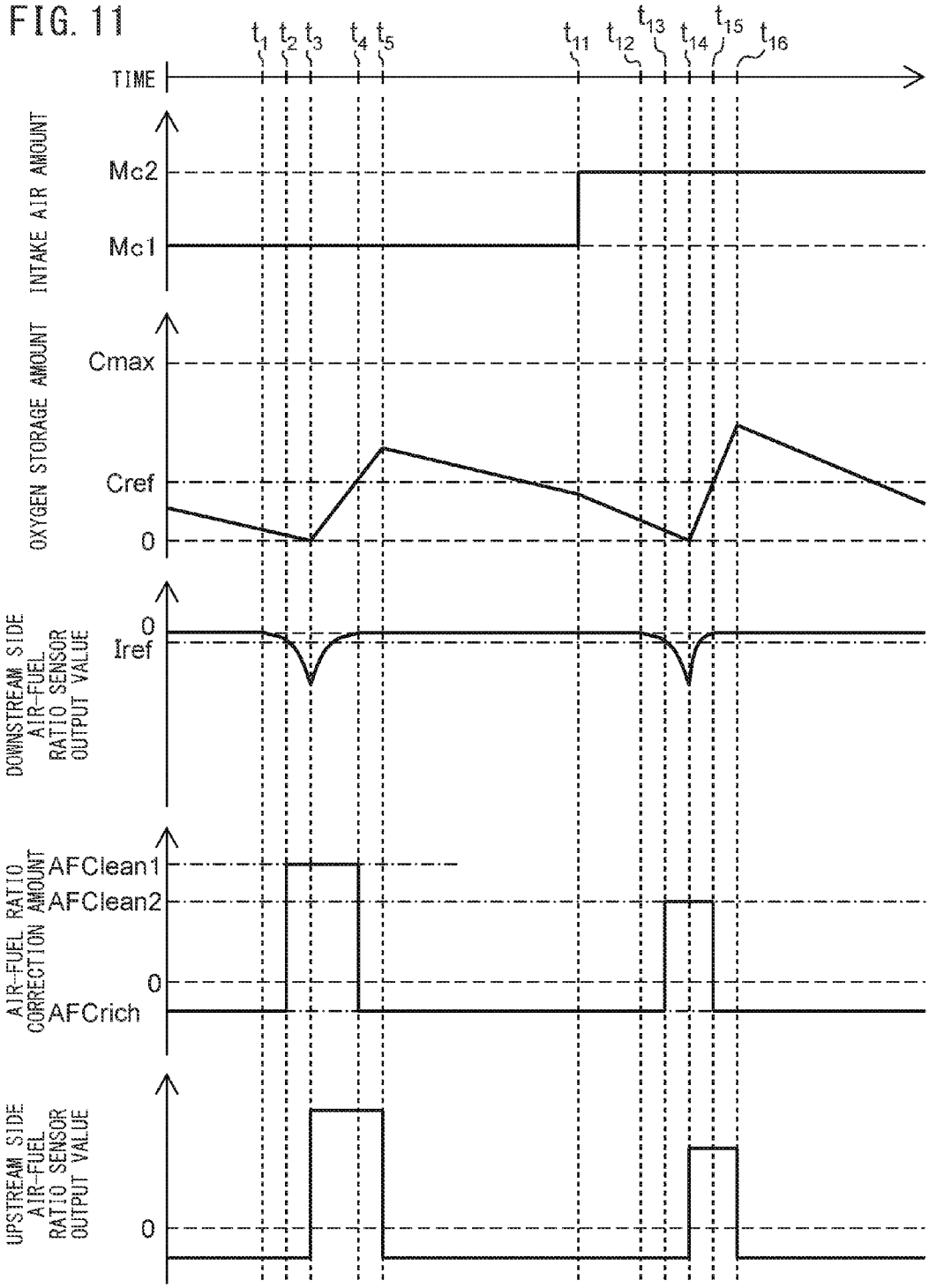
FIG. 11 is a time chart of second normal operation control of an embodiment.

FIG. 11 shows a time chart of the second normal operation control in the present embodiment. Up to the time $t_5$, control similar to the above-mentioned first normal operation control is performed. That is, up to the time $t_2$, rich control is performed, while from the time $t_2$ to the time $t_4$, lean control is performed. At the time $t_2$, the output current Irdwn of the downstream side air-fuel ratio sensor 41 reaches the rich judgment reference value Iref. At the time $t_2$, the air-fuel ratio correction amount is switched from the weak rich set correction amount AFCrich to the lean set correction amount AFClean1. At the time $t_3$, the air-fuel ratio of the exhaust gas flowing into the exhaust purification catalyst 20 becomes the lean air-fuel ratio. At the time $t_3$ on, the oxygen storage amount of the exhaust purification catalyst 20 increases, while at the time $t_4$, the oxygen storage amount reaches the judgment reference storage amount Cref. At the time $t_4$, the air-fuel ratio correction amount is switched from the lean set correction amount AFClean1 to the weak rich set correction amount AFCrich. At the time $t_5$ on, the oxygen storage amount gradually decreases.

Here, up to time $t_{11}$, the requested load is constant and the intake air amount Mc1 is constant. Up to the time $t_{11}$, the load is relatively low. The intake air amount Mc1 is a low intake air amount. At the time $t_{11}$, the requested load increases and becomes a high load. The intake air amount is changed from the low intake air amount to the high intake air amount. In the example of control shown in FIG. 11, the intake air amount Mc1 increases to the intake air amount Mc2. If the intake air amount Mc increases, the amount of exhaust gas flowing into the exhaust purification catalyst 20 per unit time increases.

Around the time $t_{11}$ as well, the air-fuel ratio correction amount is maintained at the weak rich set correction amount AFCrich. However, the flow rate of exhaust gas flowing into the exhaust purification catalyst 20 increases, so at the time $t_{11}$ on, the speed of decrease of the oxygen storage amount becomes faster. At the time $t_{12}$, the output current Irdwn of the downstream side air-fuel ratio sensor 41 starts to descend from zero and, at the time $t_{13}$, reaches the rich judgment reference value Iref. At the time $t_{13}$, rich control is switched to lean control. At the time $t_{14}$, the output value of the upstream side air-fuel ratio sensor 40 changes from the rich air-fuel ratio to the lean air-fuel ratio.

At the lean control of time $t_{13}$ on, at the time $t_{11}$, the intake air amount increases, so control is performed to lower the lean set air-fuel ratio. The air-fuel ratio correction amount is set to the lean set correction amount AFClean2. The lean set correction amount AFClean2 is set smaller than the lean set correction amount AFClean1. The output current Irup of the upstream side air-fuel ratio sensor 40 at the lean control at the time $t_{13}$ on becomes smaller than the output current Irup of the upstream side air-fuel ratio sensor 40 in the previous lean control. In this way, in the lean control starting from time $t_{13}$, the lean air-fuel ratio of the exhaust gas flowing into the exhaust purification catalyst 20 is made richer than the lean air-fuel ratio of the lean control starting from the time $t_2$. In the example of control shown in FIG. 11, while the air-fuel ratio correction amount is made smaller, the intake air amount increases, so the speed of rise of the oxygen storage amount becomes faster than the previous lean control from the time $t_2$ to the time $t_4$.

At the time $t_{15}$, the estimated value OSAest of the oxygen storage amount reaches the judgment reference storage amount Cref and lean control is switched to rich control. The air-fuel ratio correction amount is switched from the lean set correction amount AFClean2 to the weak rich set correction amount AFCrich. At the time $t_{16}$, the output value of the upstream side air-fuel ratio sensor 40 is switched from the lean air-fuel ratio to the rich air-fuel ratio. The oxygen storage amount gradually decreases at the time $t_{16}$ on.

In the example of control shown in FIG. 11, control is performed to lower the lean set air-fuel ratio the more the intake air amount is increased. Here, in the example shown in FIG. 11, even if making the lean set air-fuel ratio the rich side, the amount of increase of the intake air amount is large, so the time until the oxygen storage amount reaches the judgment reference storage amount becomes shorter. That is, the duration of lean control from the time $t_{13}$ to the time $t_{15}$ is shorter than the duration of lean control from the time $t_2$ to the time $t_4$. The duration of the lean control when lowering the lean set air-fuel ratio is not limited to this. It may be made longer according to the increase of the intake air amount or may be made substantially the same. Further, in the example of control shown in FIG. 11, the oxygen storage amount at the time $t_{16}$ when increasing the intake air amount is larger than the oxygen storage amount at the time $t_5$, but the control is not limited to this. Even when changing the intake air amount, the oxygen storage amount may also be maintained substantially constant.

In this way, due to performing control so that when the intake air amount is increased, that is, when the load is increased, the air-fuel ratio of the exhaust gas flowing into the exhaust purification catalyst 20 in lean control is lowered, it can be suppressed that the oxygen storage amount reaches the vicinity of the maximum oxygen storage amount Cmax due to the fact that the speed of increase of the oxygen storage amount when switching to lean control is large. For this reason, it is possible to keep down the outflow of $NO_X$ from the exhaust purification catalyst 20.

Figure 12:
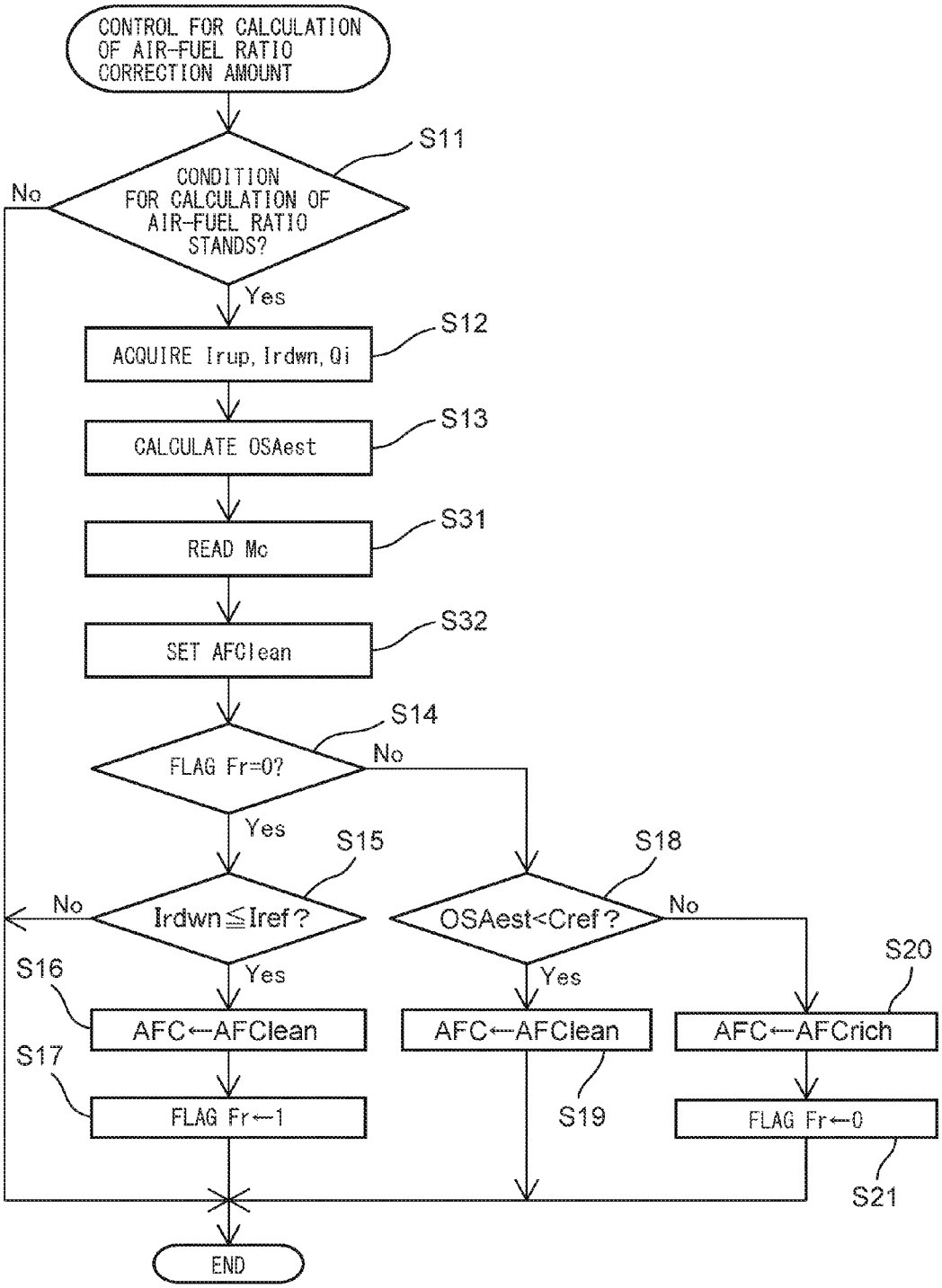
FIG. 12 is a flow chart of a control routine for calculating an air-fuel ratio correction amount in a second normal operation control of an embodiment.

FIG. 12 shows a flow chart of second normal operation control in the present embodiment. The process from step S11 to step S13 is similar to the above-mentioned first normal operation control. At step S13, the estimated value OSAest of the oxygen storage amount is calculated, then the routine proceeds to step S31. At step S31, the intake air amount Mc is read.

Next, at step S32, the lean set air-fuel ratio is set. That is, the lean set correction amount AFClean is set. Note that, in the present embodiment, the weak rich set correction amount AFCrich used is a predetermined constant correction amount even if the intake air amount changes.

Figure 13:
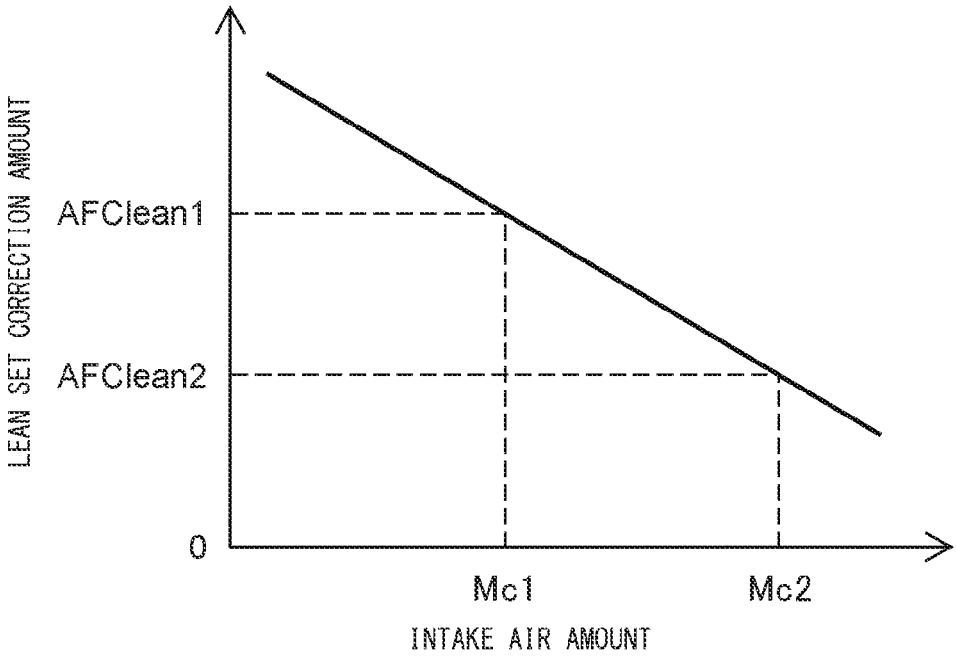
FIG. 13 is a graph showing a relationship between an intake air amount and lean set correction amount in an embodiment.

FIG. 13 shows a graph of the lean set correction amount in the second normal operation control. In all region of the intake air amount Mc, the lean set correction amount is set so that the more the intake air amount Mc is increased, the smaller the lean set correction amount AFClean is. The relationship between this intake air amount and lean set correction amount can be stored in advance in the electronic control unit 31. That is, it is possible store the lean set correction amount AFClean as a function of the intake air amount Mc in advance in the electronic control unit 31. In this way, it is possible to set the air-fuel ratio of the exhaust gas flowing into the exhaust purification catalyst 20 at lean control based on the intake air amount.

Step S14 to step S21 are similar to the above-mentioned first normal operation control. Here, at step S16, when changing the air-fuel ratio correction amount from the weak rich set correction amount AFCrich to the lean set correction amount AFClean to switch from rich control to lean control, the lean set correction amount AFClean set at step S32 is used.

Further, in lean control, when, at step S18, the estimated value OSAest of the oxygen storage amount is smaller than the judgment reference storage amount Cref, lean control is continued. In this case, at step S19, as the air-fuel ratio correction amount AFC, the lean set correction amount AFClean set at step S32 is employed. The lean set correction amount is changed based on the intake air amount, so control is performed to change the lean set correction amount when the intake air amount changes even during the time period when continuing lean control.

Note that, during the time period when the lean control is performed, control may be performed to maintain the lean set correction amount at the time of switching from rich control to lean control. That is, during the time period of lean control, control may be performed to maintain the lean set correction amount constant.

In the present embodiment, control is performed to set the lean set air-fuel ratio to the rich side (set it smaller) the more the intake air amount is increased, but the control is not limited to this so long as control to set the lean set air-fuel ratio at the first intake air amount to the rich side (set it smaller) from the lean set air-fuel ratio at the second intake air amount when comparing the lean set air-fuel ratios at any first intake air amount with the lean set air-fuel ratio at the second intake air amount smaller than the first intake air amount is included. For example, it is also possible that a region of a high intake air amount where the intake air amount is judged large and a region of a low intake air amount smaller than the region of the high intake air amount are set in advance and the lean set correction amounts are set to constant values in the regions. In this case, the lean set correction amount at the region of the high intake air amount can be set lower than the lean set correction amount at the region of the low intake air amount.

Figure 14:
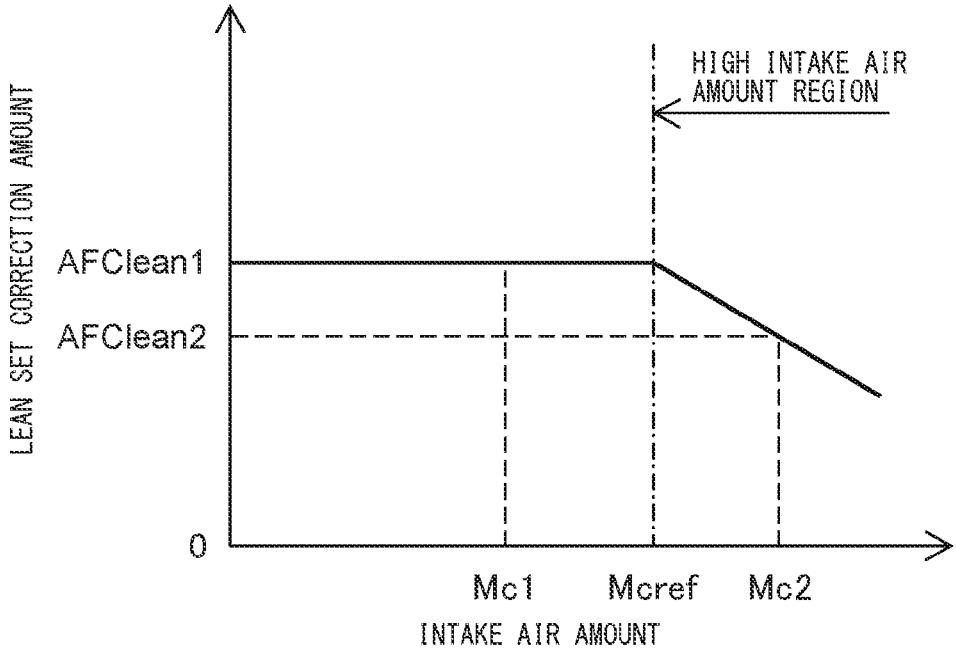
FIG. 14 is a graph showing another relationship between an intake air amount and lean set correction amount in an embodiment.

FIG. 14 shows a graph explaining another relationship of a lean set correction amount with respect to an intake air amount in the present embodiment. In other control for setting a lean set correction amount, the region of the high intake air amount where the intake air amount is judged large is set in advance. The region which is the intake air amount judgment reference value Mcref or more is set as the region of the high intake air amount.

In the region of the high intake air amount, the more the intake air amount Mc increases, the more the lean set air-fuel ratio is decreased. However, in the region smaller than the intake air amount judgment reference value Mcref, the lean set air-fuel ratio is maintained constant. That is, in the region of the low intake air amount and the region of the medium extent of intake air amount, control is performed to maintain the lean set correction amount constant and to change the lean set correction amount only in the region of the high intake air amount.

In the region of the low intake air amount and the region of the medium extent of intake air amount, the flow rate of the exhaust gas flowing into the exhaust purification catalyst 20 is small or a medium extent, so when the air-fuel ratio correction amount is switched to the lean set air-fuel ratio, the speed of increase of the oxygen storage amount of the exhaust purification catalyst 20 is kept relatively low. As opposed to this, in the region of the high intake air amount, the speed of increase of the oxygen storage amount of the exhaust purification catalyst 20 becomes larger and the oxygen storage amount easily approaches the judgment reference storage amount Cref. For this reason, in other control for setting the lean set correction amount, in the region of less than the predetermined intake air amount judgment reference value Mcref, a constant lean set correction amount is set. In the region of the intake air amount judgment reference value Mcref or more, the more the intake air amount increases, the more the lean set correction amount is decreased. In this way, in part of the region of the intake air amount, control may be performed to make the lean set air-fuel ratio the rich side if the intake air amount increases.

Further, in the above embodiment, the lean set air-fuel ratio is made to continuously change with respect to an increase in the intake air amount, but the control is not limited to this. The lean set air-fuel ratio may also be made to discontinuously change with respect to an increase in the intake air amount. For example, the lean set air-fuel ratio may also be made to decrease in steps with respect to an increase of the intake air amount.

Explanation of Third Normal Operation Control

Figure 15:
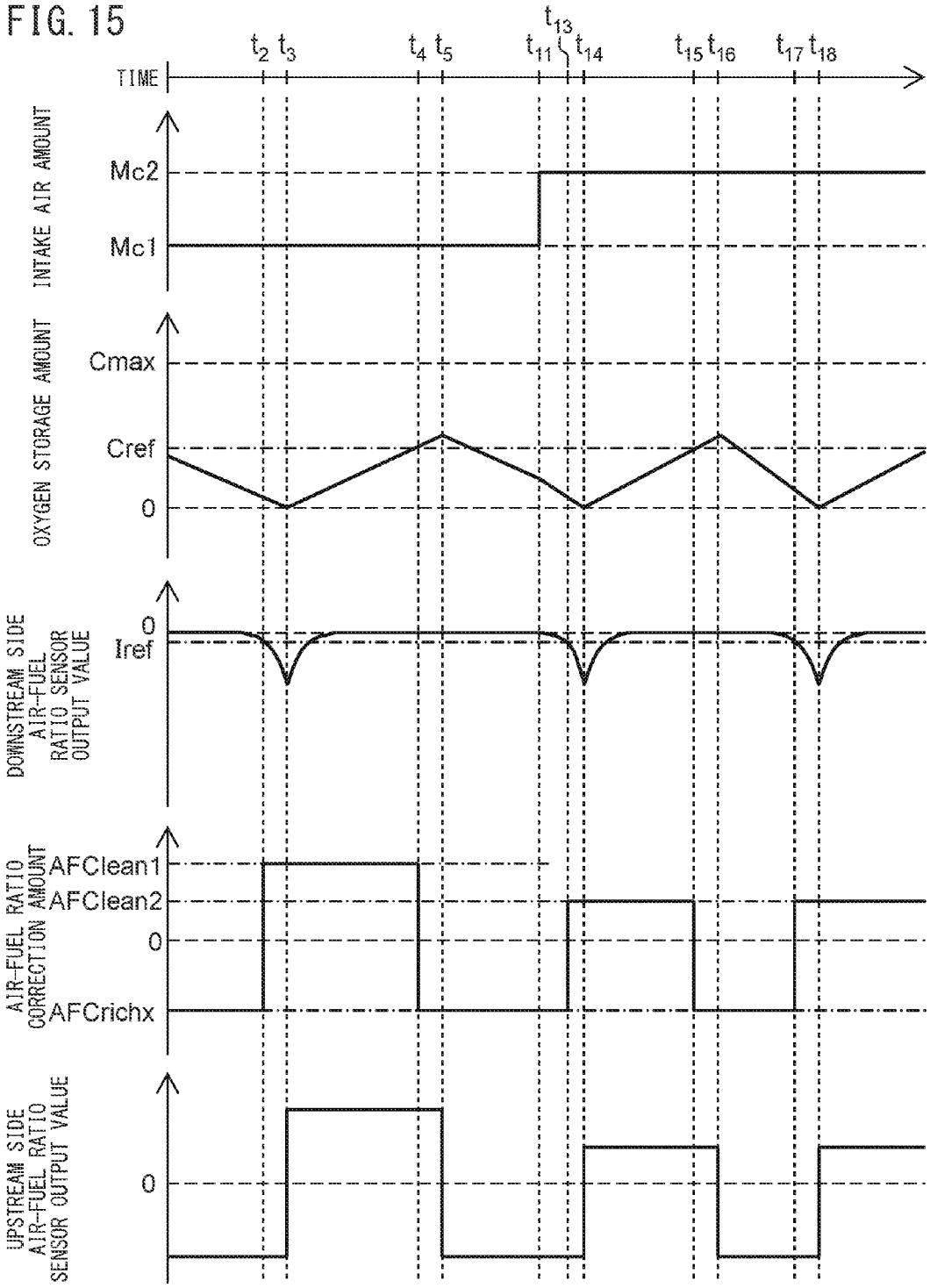
FIG. 15 is a time chart of third normal operation control of an embodiment.
Figure 16:
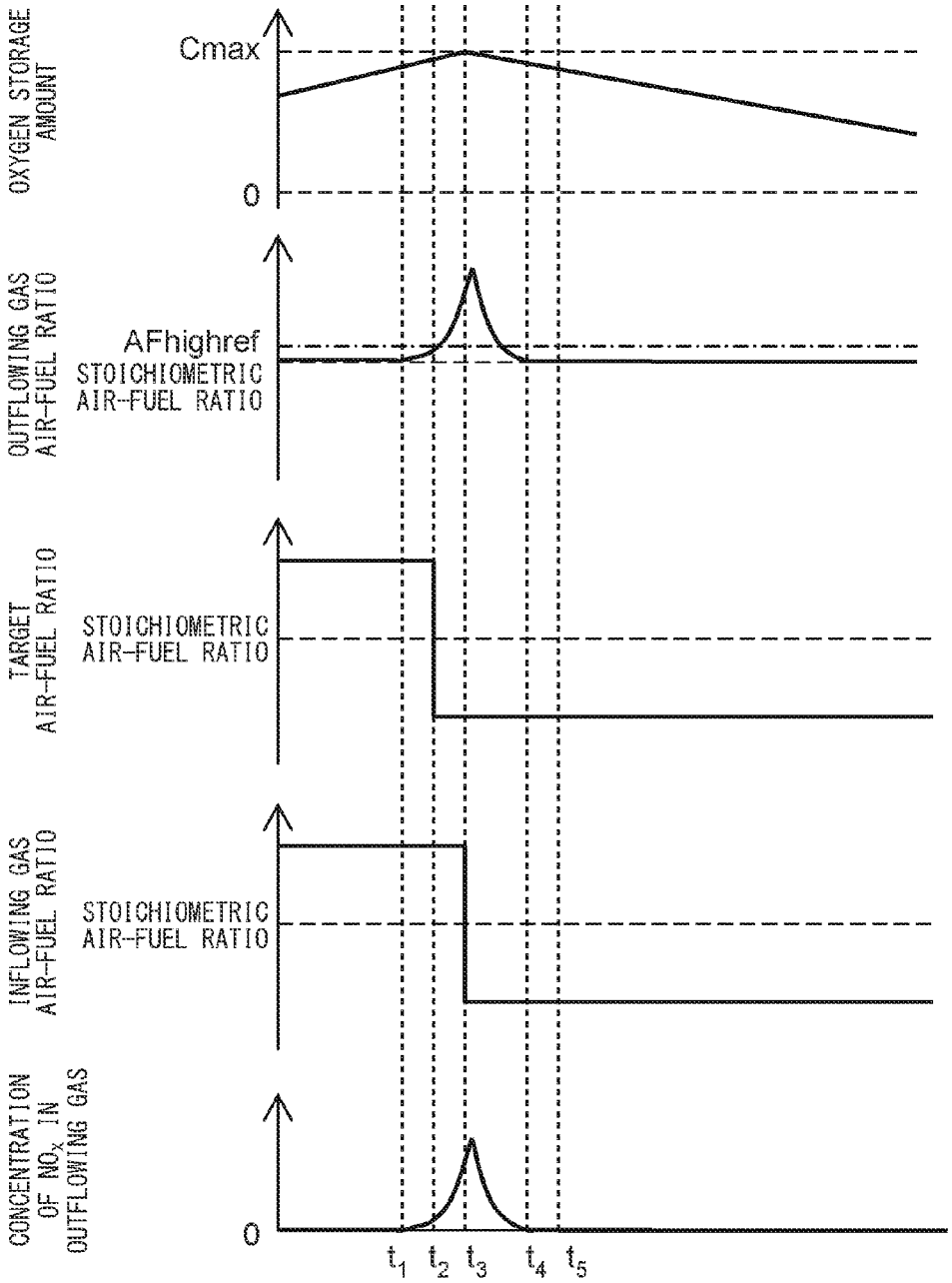
FIG. 16 is a time chart of control in the prior art.

FIG. 15 shows a time chart of the third normal operation control in the present embodiment. In the third normal operation control, control is performed so that the depth of the rich set air-fuel ratio and the depth of the lean set air-fuel ratio become substantially the same when the intake air amount Mc is small. That is, the absolute value of the rich set correction amount AFCrichx is controlled so as to become substantially the same as the absolute value of the lean set correction amount AFClean1. The depth of the rich set air-fuel ratio and the depth of the lean set air-fuel ratio are substantially the same, so the duration of rich control and the duration of lean control become substantially the same.

At the time $t_2$, the air-fuel ratio correction amount is switched from the rich set correction amount AFCrichx to the lean set correction amount AFClean1. At the time $t_4$, the air-fuel ratio correction amount is switched from the lean set correction amount AFClean1 to the rich set correction amount AFCrichx. At the time $t_{11}$, the load increases and the intake air amount Mc1 increases to the intake air amount Mc2. At the time $t_{13}$, the output current Irdwn of the downstream side air-fuel ratio sensor 41 reaches the rich judgment reference value Iref. The air-fuel ratio correction amount is switched from the rich set correction amount AFCrichx to the lean set correction amount AFClean2. At this time, at the time $t_{11}$, the intake air amount increases, so the lean set correction amount AFClean2 is set smaller than the lean set correction amount AFClean1 at the previous time of lean control.

At the time $t_{15}$, lean control is switched to rich control, while at the time $t_{16}$, the output value of the upstream side air-fuel ratio sensor changes from the lean air-fuel ratio to the rich air-fuel ratio. Furthermore, at the time $t_{17}$, the rich control is switched to lean control, while at the time the output value of the upstream side air-fuel ratio sensor is switched from the rich air-fuel ratio to the lean air-fuel ratio. Even when switching from rich control to lean control at the time $t_{17}$, since the intake air amount is the high intake air amount Mc2, the lean set correction amount AFClean2 is employed.

In the third normal operation control of the present embodiment, in the region of a large intake air amount, the absolute value of the lean set correction amount AFClean2 becomes smaller than the absolute value of the rich set correction amount AFCrichx. That is, in the region of the high intake air amount, the depth of the lean set air-fuel ratio becomes shallower than the depth of the rich set air-fuel ratio. If, in this way, the intake air amount becomes larger, the absolute value of the lean set correction amount may also become smaller than the absolute value of the rich set correction amount.

In the present embodiment, the intake air flow rate Ga and the engine speed NE are used as the basis to estimate the intake air amount Mc, but the invention is not limited to this. When the operating state of the internal combustion engine relating to the intake air amount changes, it can be determined that the intake air amount has increased. For example, it is also possible to determine that the intake air amount has increased when the requested load has increased.

In the lean control of the present embodiment, the air-fuel ratio of the exhaust gas flowing into the exhaust purification catalyst is made continuously leaner than the stoichiometric air-fuel ratio until the oxygen storage amount becomes the judgment reference storage amount or more, but the invention is not limited to this. The air-fuel ratio of the exhaust gas flowing into the exhaust purification catalyst may also be made leaner than the stoichiometric air-fuel ratio intermittently. Further, in the same way, in rich control as well, the air-fuel ratio of the exhaust gas flowing into the exhaust purification catalyst can be made a rich set air-fuel ratio richer than the stoichiometric air-fuel ratio continuously or intermittently until the output of the downstream side air-fuel ratio sensor becomes the rich judged air-fuel ratio or less.

In the above-mentioned control, the order of the steps can be suitably changed in a range where the functions and actions are not changed. In the above-mentioned figures, the same or equivalent parts are assigned the same notations. Note that, the above embodiment is an illustration and does not limit the invention. Further, in the embodiment, changes in form shown in the claims are included.

REFERENCE SIGNS LIST

11. fuel injector
18. throttle valve
20. exhaust purification catalyst
31. electronic control unit
39. air flowmeter
40. upstream side air-fuel ratio sensor
41. downstream side air-fuel ratio sensor
42. accelerator pedal
43. load sensor

The invention claimed is:

1. A control system of an internal combustion engine provided with an exhaust purification catalyst having an oxygen storage ability in an engine exhaust passage, the control system comprising:

an upstream side air-fuel ratio sensor arranged upstream of the exhaust purification catalyst and detecting the air-fuel ratio of the exhaust gas flowing into the exhaust purification catalyst;

a downstream side air-fuel ratio sensor arranged downstream of the exhaust purification catalyst and detecting the air-fuel ratio of the exhaust gas flowing out from the exhaust purification catalyst; and an electronic control unit (ECU) configured to control the air-fuel ratio of the exhaust gas flowing into the exhaust purification catalyst based upon information input from the upstream side and downstream side air-fuel ratio sensors, wherein the ECU is configured to perform lean control to intermittently or continuously make the air-fuel ratio of the exhaust gas flowing into the exhaust purification catalyst a lean set air-fuel ratio leaner than a stoichiometric air-fuel ratio until an oxygen storage amount of the exhaust purification catalyst becomes a judgment reference storage amount, which is less than the maximum oxygen storage amount, and rich control to intermittently or continuously make the air-fuel ratio of the exhaust gas flowing into the exhaust purification catalyst a rich set air-fuel ratio richer than the stoichiometric air-fuel ratio until an output of the downstream side air-fuel ratio sensor becomes a rich judged air-fuel ratio, which is an air-fuel ratio richer than the stoichiometric air-fuel ratio, perform control to switch to the rich control when the oxygen storage amount becomes the judgment reference storage amount or more during the time period of lean control and switch to the lean control when the output of the downstream side air-fuel ratio sensor becomes the rich judged air-fuel ratio or less during the time period of rich control, and further perform control to set the lean set air-fuel ratio to a rich side when an intake air amount reaches a predetermined high intake air amount region, and wherein the ECU is configured to estimate the oxygen storage amount based on an output of the upstream side air-fuel ratio sensor.

2. The control system of the internal combustion engine according to claim 1, wherein the ECU is configured to perform control to set the lean set air-fuel ratio further to a rich side the more the intake air amount increases.

3. The control system of the internal combustion engine according to claim 1, wherein in the region of the predetermined high intake air amount, the lean set air-fuel ratio is set further to the rich side the more the intake air amount increases, and, in a region of an intake air amount smaller than the region of the high intake air amount, the lean set air-fuel ratio is maintained constant.

* * * * *